US009701131B2

(12) United States Patent
Ookubo et al.

(10) Patent No.: US 9,701,131 B2
(45) Date of Patent: Jul. 11, 2017

(54) THERMAL HEAD AND THERMAL PRINTER

(71) Applicant: KYOCERA Corporation, Kyoto-shi, Kyoto (JP)

(72) Inventors: Yuuna Ookubo, Kyoto (JP); Yasumitsu Yamamoto, Kyoto (JP); Masafumi Hirayama, Kyoto (JP); Shouji Hirose, Kyoto (JP); Takumi Hatanaka, Kyoto (JP); Hisatoshi Takada, Kyoto (JP); Youichi Moto, Kyoto (JP); Yui Tanaka, Kyoto (JP); Yousuke Iwamoto, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/108,053

(22) PCT Filed: Nov. 27, 2014

(86) PCT No.: PCT/JP2014/081403

§ 371 (c)(1),
(2) Date: Jun. 24, 2016

(87) PCT Pub. No.: WO2015/098423

PCT Pub. Date: Jul. 2, 2015

(65) Prior Publication Data

US 2016/0325557 A1 Nov. 10, 2016

(30) Foreign Application Priority Data

Dec. 25, 2013 (JP) ..... 2013-267387

(51) Int. Cl.
*B41J 2/335* (2006.01)
*B41J 2/345* (2006.01)

(52) U.S. Cl.
CPC ..... *B41J 2/3351* (2013.01); *B41J 2/3352* (2013.01); *B41J 2/3354* (2013.01); *B41J 2/3357* (2013.01); *B41J 2/345* (2013.01)

(58) Field of Classification Search
CPC .... B41J 2/335; B41J 2/33505; B41J 2/33595; B41J 2/345; B41J 2/3351; B41J 2/33515;
(Continued)

(56) References Cited

U.S. PATENT DOCUMENTS 5,568,174 A 10/1996 Nagahata et al.
5,907,347 A 5/1999 Nagahata et al.
(Continued)

FOREIGN PATENT DOCUMENTS

CN 1173846 A 2/1998
JP 01-107479 A 4/1989
(Continued)

OTHER PUBLICATIONS

Chinese Office Action with English concise explanation, Chinese Patent Application No. 201480070178.1, Nov. 30, 2016, 9 pgs.
(Continued)

*Primary Examiner* — Kristal Feggins
(74) *Attorney, Agent, or Firm* — Volpe and Koenig, P.C.

(57) ABSTRACT

A thermal head capable of reducing a possibility of separation of a connector is provided. A thermal head includes a substrate; a plurality of heat generating portions disposed on the substrate; a plurality of electrodes which are disposed on the substrate and are electrically connected to the plurality of heat generating portions, respectively; and a connector including a plurality of connector pins which pinch the substrate and are electrically connected to the plurality of electrodes, respectively, and a housing for containing the plurality of connector pins. The housing is disposed adjacent to the substrate in a sub-scanning direction, and the housing
(Continued)

includes a support portion disposed under the substrate. This can reduce a possibility of separation of the connector.

18 Claims, 16 Drawing Sheets

(58) Field of Classification Search
CPC .. B41J 2/3353; B41J 2/33535; B41J 2/33565; B41J 2/3357; B41J 2/33555; B41J 2/3352; B41J 2/3354
See application file for complete search history.

(56) References Cited

U.S. PATENT DOCUMENTS

| | | | |
|---|---|---|---|
| 6,579,125 | B1 | 6/2003 | Nagahata et al. |
| 2012/0133724 | A1 | 5/2012 | Nishi |

FOREIGN PATENT DOCUMENTS

| | | | |
|---|---|---|---|
| JP | 06-267620 | | 9/1994 |
| JP | 09-039284 | A | 2/1997 |
| JP | 2002-359022 | A | 12/2002 |
| JP | 2012-116064 | A | 6/2012 |
| WO | 2000-173695 | A | 6/2000 |

OTHER PUBLICATIONS

International Search Report, PCT/JP2014/081403, Jan. 27, 2015, 2 pgs.

(a)

(b)

(a)

(b)

(a)

(b)

THERMAL HEAD AND THERMAL PRINTER

TECHNICAL FIELD

The present invention relates to a thermal head and a thermal printer.

BACKGROUND ART

In the conventional art, various thermal heads are proposed as image printing devices such as a facsimile machine and a video printer. For example, there is known a thermal head including: a substrate; a plurality of heat generating portions disposed on the substrate; a plurality of electrodes which are disposed on the substrate and are electrically connected to the plurality of heat generating portions, respectively; and a connector including a plurality of connector pins which pinch the substrate and are electrically connected to the plurality of electrodes, respectively, and a housing for containing the plurality of connector pins (for example, see Patent Literature 1).

CITATION LIST

Patent Literature

Patent Literature 1: Japanese Unexamined Patent Publication JP-A 6-267620 (1994)

SUMMARY OF INVENTION

Technical Problem

Nevertheless, in the thermal head described above, when an external force acts on the housing, a possibility arises that the connector pins separate from the electrodes so that electrical connection is cut off.

Solution to Problem

A thermal head according to one embodiment of the invention includes: a substrate; a plurality of heat generating portions disposed on the substrate; a plurality of electrodes which are disposed on the substrate and are electrically connected to the plurality of heat generating portions, respectively; and a connector including a plurality of connector pins which pinch the substrate and are electrically connected to the plurality of electrodes, respectively, and a housing for containing the plurality of connector pins. Further, the housing is disposed adjacent to the substrate in a sub-scanning direction. Furthermore, the housing includes a support portion disposed under the substrate.

A thermal head according to another embodiment of the invention includes: a substrate; a plurality of heat generating portions disposed on the substrate; a plurality of electrodes which are provided on the substrate and are electrically connected to the plurality of heat generating portions, respectively; a wiring board which is disposed adjacent to the substrate and includes a plurality of wirings electrically connected to the plurality of electrodes, respectively; and a connector including a plurality of connector pins which pinch the wiring board and are electrically connected to the plurality of wirings, respectively, and a housing for containing the plurality of connector pins. Further, the housing is disposed adjacent to the wiring board in a sub-scanning direction. Furthermore, the housing includes a support portion disposed under the wiring board.

Further, a thermal printer according to an embodiment of the invention includes: the above-mentioned thermal head; a conveying mechanism which conveys a recording medium onto the plurality of heat generating portions; and a platen roller which presses a recording medium against the plurality of heat generating portions.

Advantageous Effects of Invention

Even in a case where an external force acts on the housing, it is possible to reduce a possibility that the connector pins separate from the electrodes.

DESCRIPTION OF EMBODIMENTS

<First Embodiment>

Figure 1:
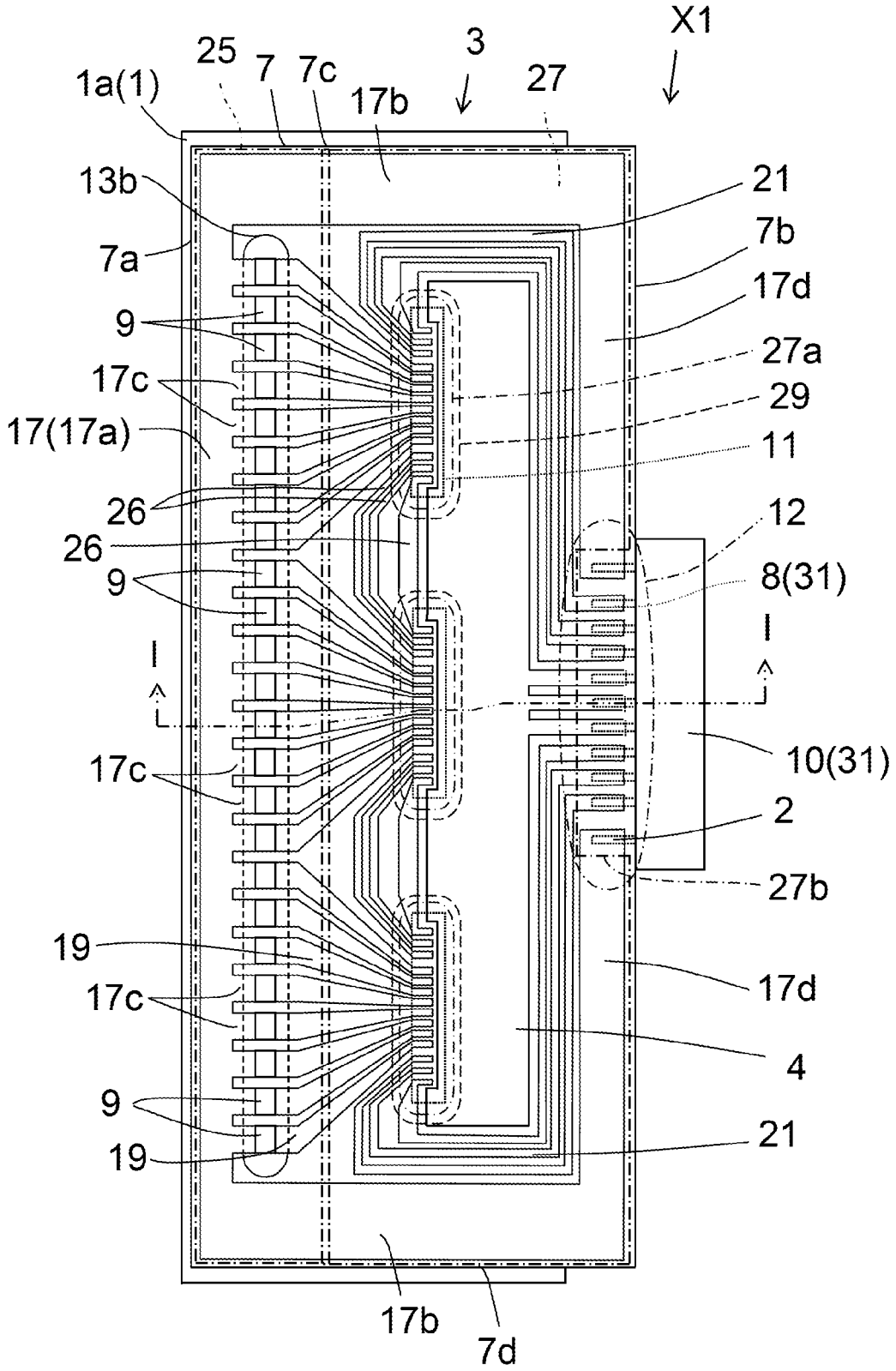
FIG. 1 is a plan view showing a thermal head according to a first embodiment.

A thermal head X1 is described below with reference to FIGS. 1 to 7. In FIG. 1, a protection layer 25, a covering layer 27, and a covering member 12 are shown in a simplified manner by dash-dotted lines. Further, in FIG. 3(*b*), the protection layer 25, the covering layer 27, and the covering member 12 are omitted. Furthermore, in FIGS. 5(*a*) and 5(*b*), the covering member 12 is shown in a simplified manner by a dash-dotted line.

The thermal head X1 includes: a heat radiating plate 1; a head base 3 disposed on the heat radiating plate 1; and a connector 31 connected to the head base 3.

The heat radiating plate 1 has a rectangular parallelepiped shape and includes a base portion 1*a* on which a substrate 7 is placed. The substrate 7 and a housing 10 of the connector 31 are disposed on the heat radiating plate 1.

For example, the heat radiating plate 1 is formed of a metallic material such as copper, iron, and aluminum, and has a function of radiating heat not contributing to image printing of heat generated by a heat generating portion 9 of the head base 3. Further, the head base 3 is bonded to an upper face of the base portion 1*a* by using a double-sided tape, an adhesive (not shown), or the like.

The head base 3 is formed in a rectangular shape in a plan view. Then, individual members constituting the thermal head X1 are disposed on the substrate 7 of the head base 3. The head base 3 has a function of performing printing onto a recording medium (not shown) in accordance with an electric signal supplied from the outside.

Figure 2:
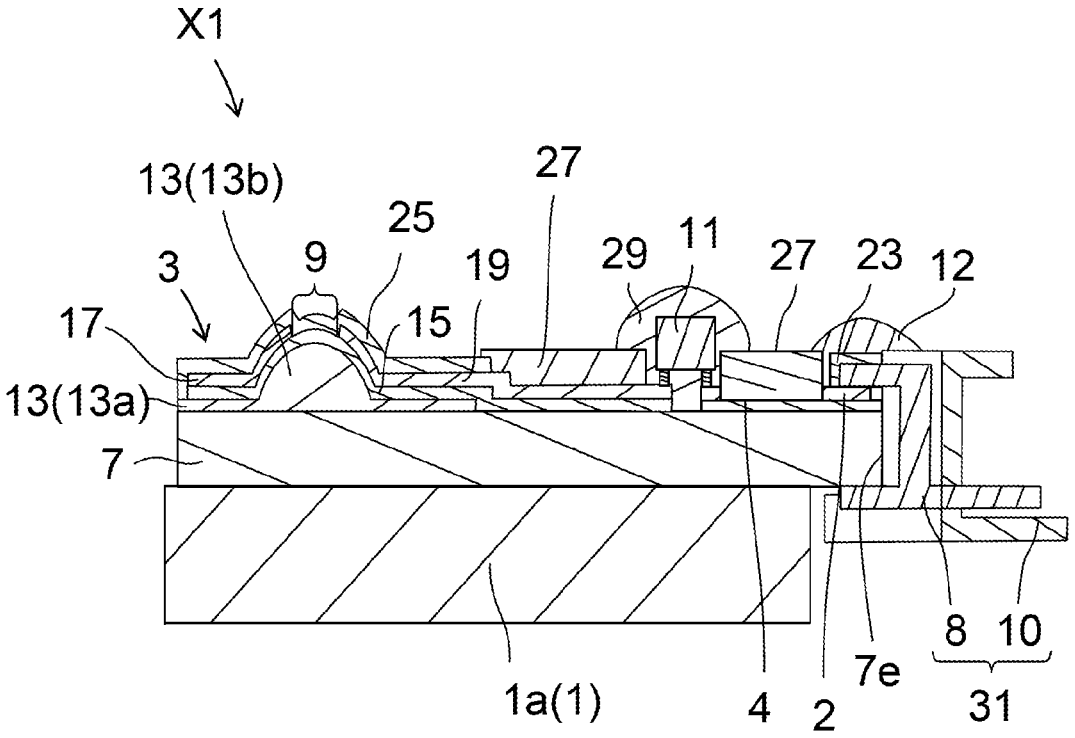
FIG. 2 is a sectional view taken along the line I-I shown in FIG. 1.
Figure 3:
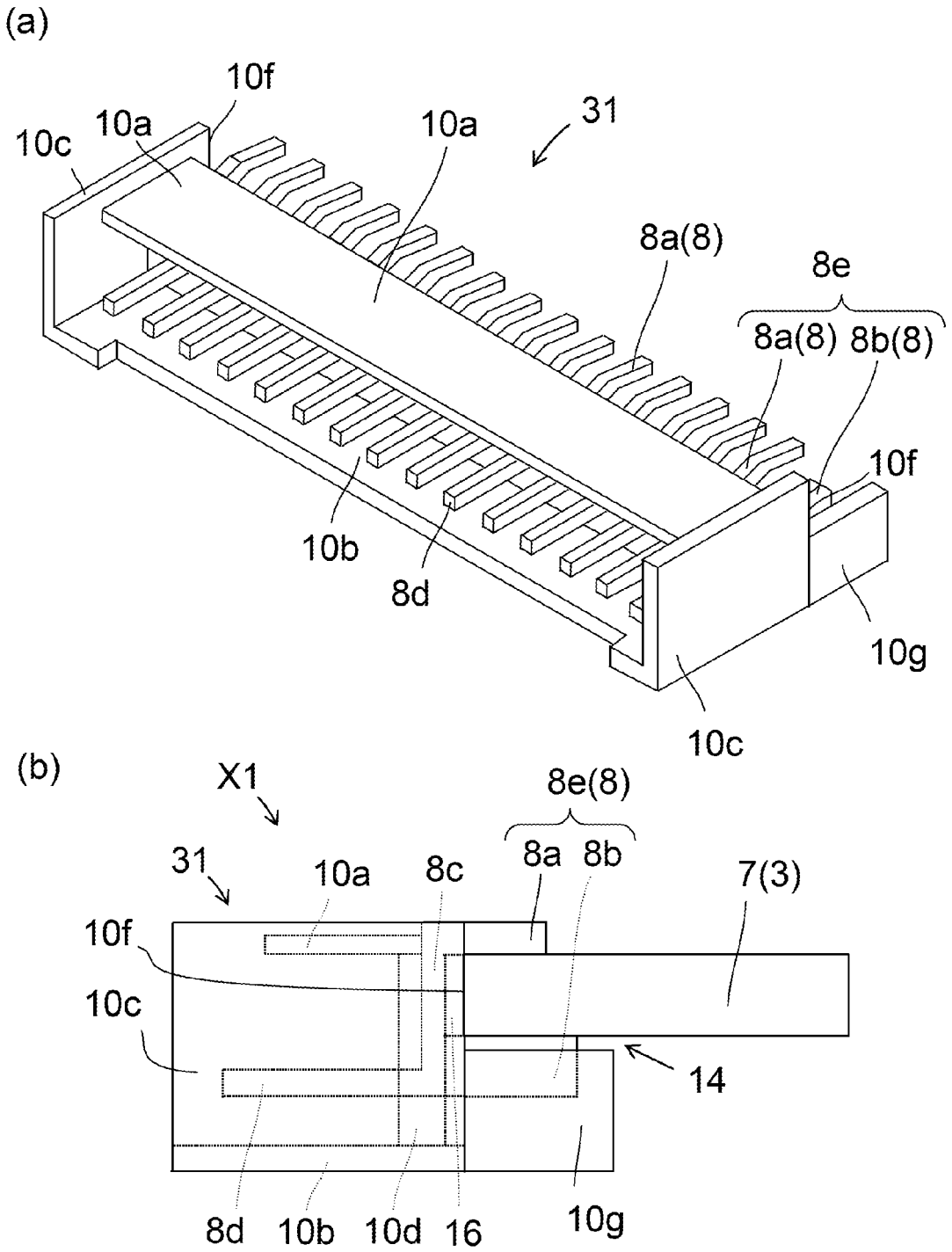
FIG. 3(*a*) is a perspective view of a connector constituting the thermal head according to the first embodiment, and FIG. 3(*b*) is a side view of the thermal head according to the first embodiment.
Figure 4:
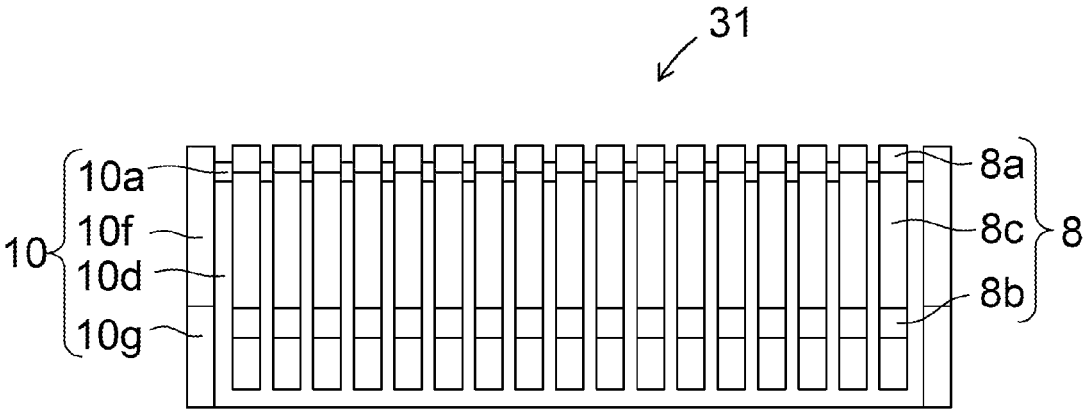
FIG. 4 shows a perspective view of a connector constituting a thermal head according to a first embodiment, wherein FIG. 4(*a*) is a front view, and FIG. 4(*b*) is a rear view.
Figure 4:
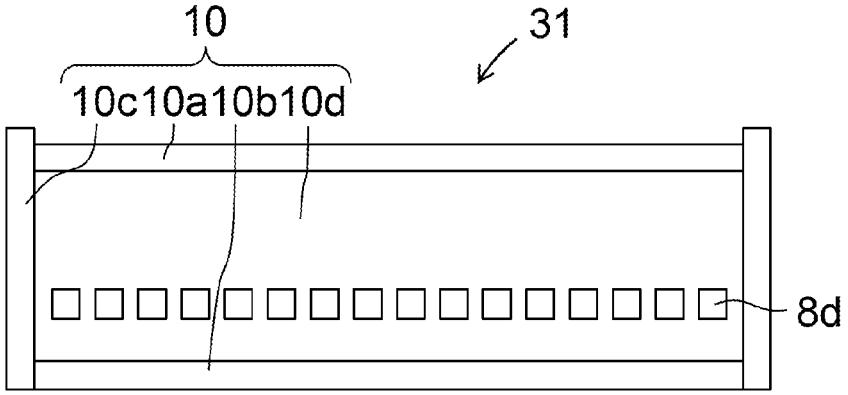
Figure 5:
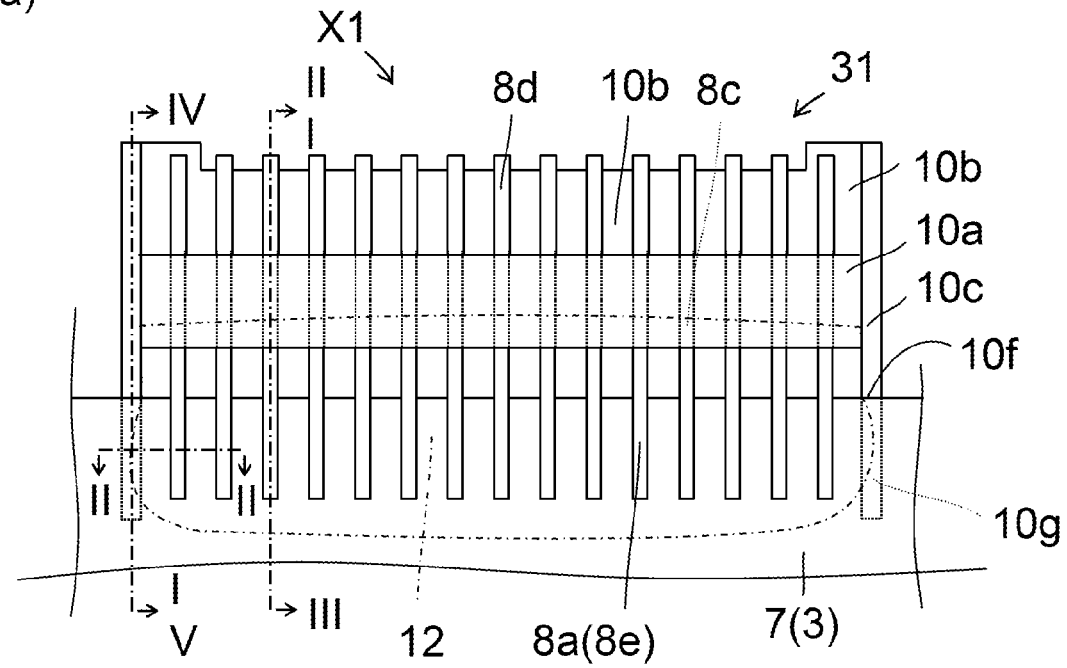
FIG. 5 shows an enlarged view of a vicinity of a connector constituting the thermal head according to the first embodiment, wherein FIG. 5(*a*) is a plan view, and FIG. 5(*b*) is a bottom view.
Figure 5:
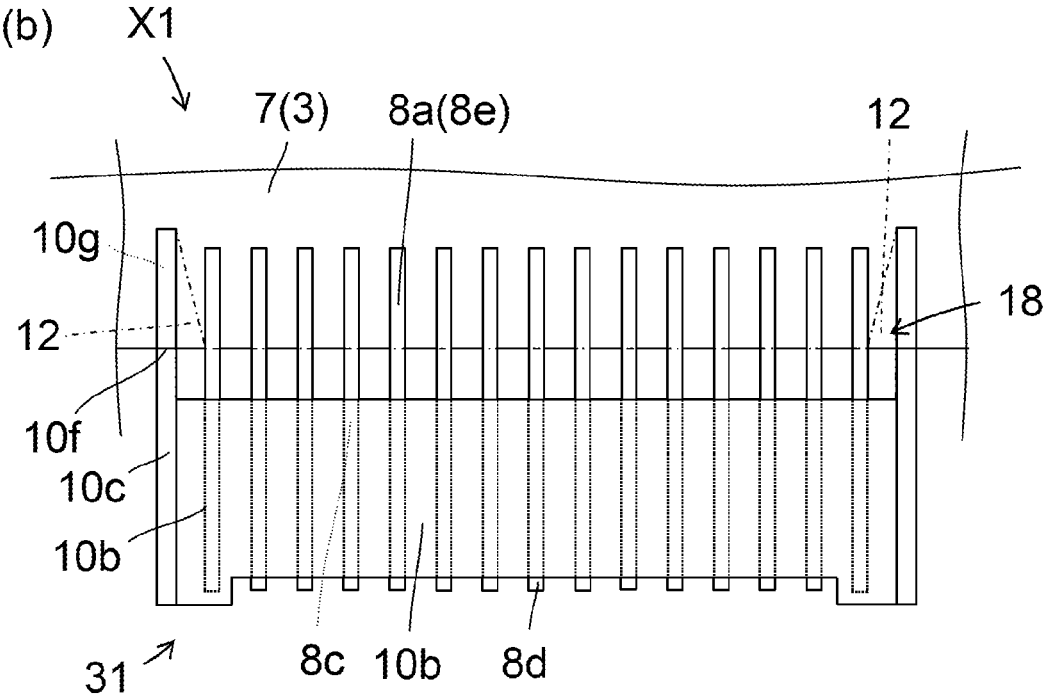
Figure 6:
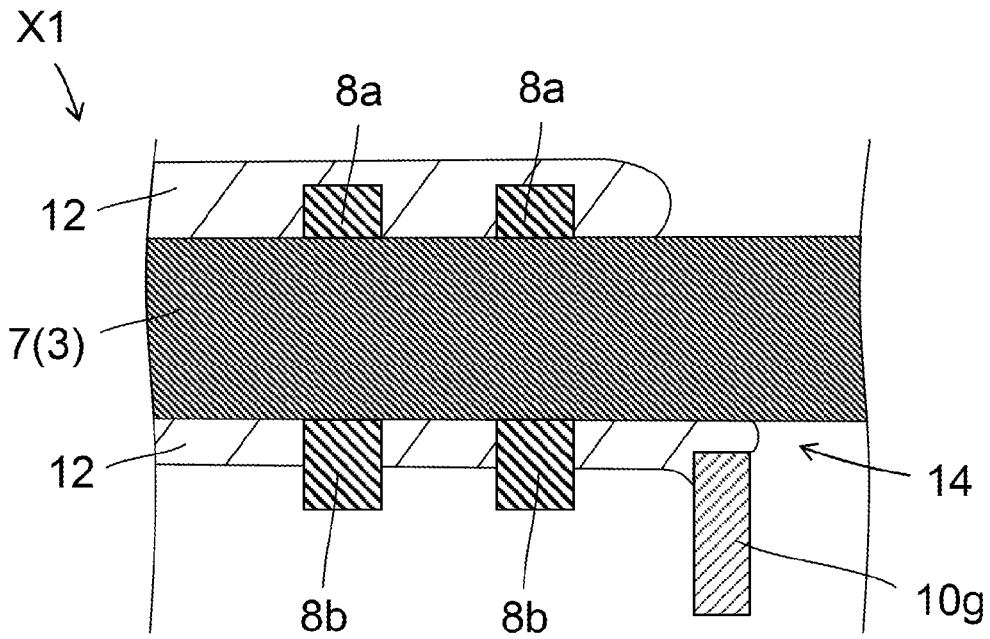
FIG. 6 is a sectional view taken along the line II-II shown in FIG. 4(*a*)
Figure 7:
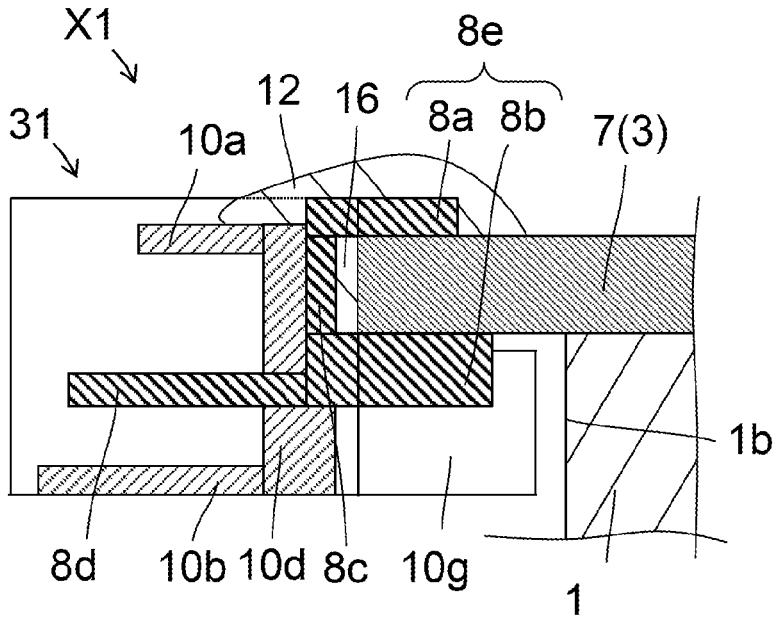
FIG. 7(*a*) is a sectional view taken along the line III-III shown in FIG. 4(*a*), and FIG. 7(*b*) is a sectional view taken along the line IV-IV shown in FIG. 4(*a*)
Figure 7:
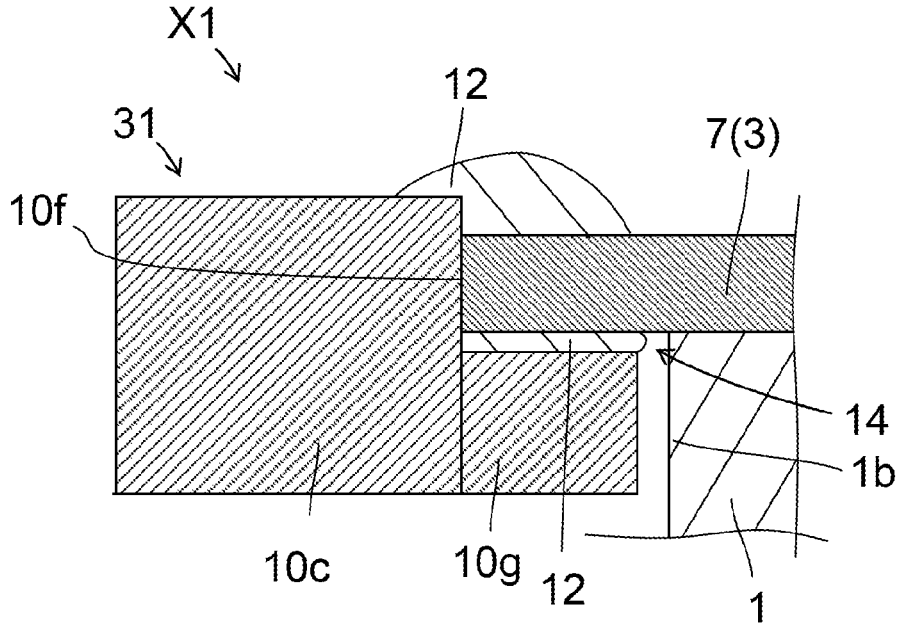

As shown in FIG. 2, the connector 31 includes: a plurality of connector pins 8; and the housing 10 for containing the plurality of connector pins 8. One side of the plurality of connector pins 8 are exposed to the outside of the housing 10 and the other side is contained in the inside of the housing 10. The plurality of connector pins 8 have a function of ensuring electric conduction between various electrodes of the head base 3 and a power supply disposed in the outside. Then, the plurality of connector pins 8 are electrically independent of each other.

Each member constituting the head base 3 is described below.

The substrate 7 is disposed on the base portion 1*a* of the heat radiating plate 1, and has a rectangular shape in a plan view. Thus, the substrate 7 has one long side 7*a*, the other long side 7*b*, one short side 7*c*, and the other short side 7*d*. Further, a side surface 7*e* is disposed on the other long side 7*b* side. For example, the substrate 7 is formed of an electrically insulating material such as alumina ceramics or from a semiconductor material such as single crystal silicon.

A heat storage layer 13 is formed on an upper face of the substrate 7. The heat storage layer 13 includes an underlayer portion 13*a* and a ridge portion 13*b*. The underlayer portion 13*a* is formed over a left half of the upper face of the substrate 7. Further, the underlayer portion 13*a* is disposed in a vicinity of the heat generating portion 9, and is disposed under the protection layer 25 described later. The ridge portion 13*b* extends in a belt shape along the arrangement direction of a plurality of the heat generating portions 9, and the cross section thereof has a substantially semi-elliptical shape. Further, the ridge portion 13*b* has a function of satisfactorily pressing a recording medium (not shown) onto which image printing is to be performed, against the protection layer 25 formed on the heat generating portion 9.

The heat storage layer 13 is formed of glass having a low thermal conductivity, and temporarily accumulates a part of the heat generated by the heat generating portion 9. Thus, the time necessary for raising the temperature of the heat generating portion 9 can be shortened and hence has a function of improving the heat response characteristics of the thermal head X1. For example, the heat storage layer 13 is formed by applying a predetermined glass paste obtained by mixing a suitable organic solvent into glass powder onto the upper face of the substrate 7 by screen printing or otherwise which is well known in the conventional art and then firing the glass paste.

An electric resistance layer 15 is disposed on an upper face of the heat storage layer 13. Then, a connection terminal 2, a ground electrode 4, a common electrode 17, an individual electrode 19, a first connecting electrode 21, and a second connecting electrode 26 are disposed on the electric resistance layer 15. The electric resistance layer 15 is patterned in the same shape as the connection terminal 2, the ground electrode 4, the common electrode 17, the individual electrode 19, the first connecting electrode 21, and the second connecting electrode 26. Then, an exposed region where the electric resistance layer 15 is exposed is formed between the common electrode 17 and the individual electrode 19. As shown in FIG. 1, the exposed regions of the electric resistance layer 15 are disposed in line on the ridge portion 13*b* of the heat storage layer 13 and then each exposed region constitutes the heat generating portion 9.

Although shown in a simplified manner in FIG. 1 for simplicity of description, the plurality of heat generating portions 9 are disposed in a density of 100 to 2400 dpi (dot per inch) or the like. The electric resistance layer 15 is formed of a TaN-based material, TaSiO-based material, TaSiNO-based material, TiSiO-based material, TiSiCO-based material, or NbSiO-based material, or the like having a relatively high electric resistance. Thus, when a voltage is applied to the heat generating portion 9, the heat generating portion 9 generates heat by Joule heating.

As shown in FIGS. 1 and 2, the connection terminal 2, the ground electrode 4, the common electrode 17, the plurality of individual electrodes 19, the first connecting electrode 21, and the second connecting electrode 26 are provided on an upper face of the electric resistance layer 15. The connection terminal 2, the ground electrode 4, the common electrode 17, the individual electrodes 19, the first connecting electrode 21, and the second connecting electrode 26 are formed of a material having electrical conductivity and, for example, formed of any one kind selected from metals consisting of aluminum, gold, silver, copper, and an alloy of these.

The common electrode 17 includes main wiring portions 17*a* and 17*d*, a sub wiring portion 17*b*, and a lead portion 17*c*. The main wiring portion 17*a* extends along the one long side 7*a* of the substrate 7. The sub wiring portion 17*b* extends along each of the one short side 7*c* and the other short side 7*d* of the substrate 7. Each lead portion 17*c* extends individually from the main wiring portion 17*a* toward each heat generating portion 9. The main wiring portion 17*d* extends along the other long side 7*b* of the substrate 7.

The common electrode 17 electrically connects the plurality of heat generating portions 9 to the connector 31. Here, in order to reduce the electric resistance of the main wiring portion 17*a*, the main wiring portion 17*a* may be in the form of a thick electrode portion (not shown) thicker than the other part of the common electrode 17. By virtue of this, the electric capacity of the main wiring portion 17*a* can be increased.

The plurality of individual electrodes 19 electrically connect the heat generating portions 9 to drive ICs 11. Further, the plurality of heat generating portions 9 are divided into a plurality of groups. Then, the individual electrodes 19 electrically connect each group of the heat generating portions 9 to each drive IC 11 disposed in correspondence to each group.

The plurality of first connecting electrodes 21 electrically connect the drive ICs 11 to the connector 31. The plurality of first connecting electrodes 21 connected to each drive IC 11 are constructed from a plurality of wirings having different functions.

The ground electrode 4 is disposed so as to be surrounded by the individual electrodes 19, the first connecting electrodes 21, and the main wiring portion 17*d* of the common electrode 17, and has a large area. The ground electrode 4 is held at a ground potential of 0 to 1 V.

In order to connect the common electrode 17, the individual electrodes 19, the first connecting electrodes 21, and the ground electrode 4 to the connector 31, the connection terminals 2 are disposed on the other long side 7*b* side of the substrate 7. The connection terminals 2 are disposed in correspondence to the connector pins 8. Then, at the time of connection to the connector 31, the connection terminals 2 are connected to the connector pins 8 in a manner of being electrically independent of each other.

Each of the plurality of second connecting electrodes 26 electrically connects adjacent drive ICs 11 to each other. The plurality of second connecting electrodes 26 are disposed individually in correspondence to the first connecting electrodes 21, and transmit various signals to adjacent drive ICs 11.

The electric resistance layer 15, the connection terminals 2, the common electrode 17, the individual electrodes 19, the ground electrode 4, the first connecting electrodes 21, and the second connecting electrodes 26 described above are formed, for example, by successively laminating material layers for constituting the respective components on the heat storage layer 13 by a thin film forming technique such as sputtering which is well known in the conventional art and, after that, processing the laminate into a predetermined pattern by using photo-etching or the like which is well known in the conventional art. Here, the connection terminals 2, the common electrode 17, the individual electrodes 19, the ground electrode 4, the first connecting electrodes 21, and the second connecting electrodes 26 can be formed simultaneously in the same process.

As shown in FIG. 1, each drive IC 11 is disposed in correspondence to each group of the plurality of heat generating portions 9 and connected to the other end portion of the individual electrodes 19, and the one end portion of the first connecting electrodes 21. The drive IC 11 has a function of controlling the energized state of each heat generating portion 9. The drive IC 11 may be constructed from a switching member including a plurality of switching elements in the inside.

In a state where the drive IC 11 is connected to the individual electrodes 19, the second connecting electrodes 26, and the first connecting electrodes 21, for the purpose of protection of the drive IC 11 and protection of the connection portion between the drive IC 11 and these wirings, the drive IC 11 is sealed with a coating resin 29 composed of a resin such as an epoxy resin or a silicone resin.

As shown in FIGS. 1 and 2, the protection layer 25 for covering the heat generating portions 9, a part of the common electrode 17, and a part of the individual electrodes 19 is formed on the heat storage layer 13 formed on the upper face of the substrate 7.

The protection layer 25 has a function of protecting the covered region of the heat generating portions 9, the common electrode 17, and the individual electrodes 19 from corrosion caused by adhesion of water contained in the atmosphere or from wear caused by contact with the recording medium for image printing. The protection layer 25 may be formed from SiN, $SiO_2$, SiON, SiC, diamond-like carbon, or the like. Further, the protection layer 25 may be constructed from a laminate of these layers. Such a protection layer 25 may be fabricated by using a thin film forming technique such as sputtering or a thick film forming technique such as screen printing.

Further, as shown in FIGS. 1 and 2, the covering layer 27 for partly covering the common electrode 17, the individual electrodes 19, and the first connecting electrodes 21 is dispsoed on the substrate 7. The covering layer 27 has a function of protecting the covered region of the common electrode 17, the individual electrodes 19, the second connecting electrodes 26, and the first connecting electrodes 21 from oxidization caused by contact with the atmosphere or from corrosion caused by adhesion of water contained in the atmosphere.

Here, in order to make the protection of the common electrode 17 and the individual electrodes 19 more definite, it is preferable that the covering layer 27 is formed so as to overlap with an end portion of the protection layer 25 as shown in FIG. 2. For example, the covering layer 27 may be formed of a resin material such as an epoxy resin or a polyimide resin by using a thick film forming technique such as screen printing.

The covering layer 27 is provided with an opening portion 27*a* for exposing the individual electrodes 19, the second connecting electrodes 26, and the first connecting electrodes 21 to be connected to the drive IC 11. Then, these wirings exposed through the opening portion 27*a* are connected to the drive IC 11. Further, in the covering layer 27, an opening portion 27*b* for exposing the connection terminals 2 is disposed on the other long side 7*b* side of the substrate 7. The connection terminals 2 exposed through the opening portion 27*b* are electrically connected to the connector pins 8.

Next, the connector 31 and joining between the connector 31 and the head base 3 are described below in detail.

The connector 31 includes the plurality of connector pins 8 and the housing 10 for containing the plurality of connector pins 8. Parts of the connector pins 8 are buried in the housing 10.

The connector pin 8 includes a first connector pin 8*a*, a second connector pin 8*b*, a third connector pin 8*c*, and a fourth connector pin 8*d*. In the connector pins 8, at least the first connector pin 8*a* and the second connector pin 8*b* are linked together by the third connector pin 8*c* so that the first connector pin 8*a* and the second connector pin 8*b* form a pinching portion 8*e*. The plurality of connector pins 8 are disposed with intervals in the main scanning direction. Then, adjacent connector pins 8 are electrically insulated from each other.

The first connector pins 8*a* is disposed on the connection terminal 2 (see FIG. 1). The second connector pin 8*b* is disposed under the substrate 7 of the head base 3. Then, the pinching portion 8*e* formed by the first connector pin 8*a* and the second connector pin 8*b* pinches the head base 3. The third connector pin 8*c* is linked by the first connector pin 8*a* and the second connector pin 8*b*, and is disposed so as to extend in the thickness direction. The fourth connector pin 8*d* is drawn out in a direction of traveling away from the head base 3 and provided so as to be continuous to the second connector pin 8*b*. The pinching portion 8*e* is formed by the first connector pin 8*a* and the second connector pin 8*b* and then pinches the head base 3 so as to electrically and mechanically link the connector 31 to the head base 3. The connector 31 and the head base 3 are linked together when the head base 3 is inserted into the pinching portion 8*e* of the connector pin 8.

The connector pin 8 need have electrical conductivity and hence may be formed of metal or an alloy. The housing 10 may be formed of an electrically insulating member and, for example, may be formed of resin such as PA (polyamide), PBT (poly butylene terephthalate), LCP (liquid crystal polymer), nylon 66, and glass-containing nylon 66.

The housing 10 has a box shape and has a function of containing the individual connector pins 8 in a state of being electrically independent of each other. A socket is inserted from the outside into an opening portion of the housing 10. Then, electricity is provided to the head base 3 in association with attaching and detaching of a socket (not shown) disposed in the outside.

The housing 10 includes an upper wall 10*a*, a lower wall 10*b*, side walls 10*c*, a front wall 10*d*, positioning portions 10*f*, and support portions 10*g*. In the housing 10, an opening portion is formed on the fourth connector pin 8*d* side of the connector pins 8 by the upper wall 10*a*, the lower wall 10*b*, the side walls 10*c*, and the front wall 10*d*. The positioning portions 10*f* have a function of positioning the head base 3 inserted. The housing 10 is provided with the positioning portions 10*f* and hence has a configuration that the head base 3 cannot abut against the third connector pin 8*c* of the connector pin 8. This can reduce a possibility that the connector pin 8 is bent or the like and hence damaged.

The support portion 10*g* is provided in a state of protruding from the side wall 10*c* to the underside of the substrate 7. Then, the support portion 10*g* and the substrate 7 are disposed apart from each other. Thus, a space 14 is formed between the support portion 10*g* and the substrate 7. Further, the support portion 10*g* protrudes from the housing 10 beyond the connector pins 8. This can reduce a possibility that the connector pins 8 come into contact with the outside and hence reduce a possibility of occurrence of damage in the connector pins 8.

Here, in a case where the pinching portions 8*e* of the connector pins 8 pinch the substrate 7 so that the connector 31 is fixed to the head base 3, when an external force (especially, a force in the vertical direction) acts on the housing 10, a possibility arises that the connector pins 8 separate from the connection terminals 2 so that electrical connection is cut off.

However, the thermal head X1 has a configuration that the housing 10 is disposed adjacent to the substrate 7 in the sub-scanning direction and the housing 10 includes the support portions 10*g* disposed under the substrate 7. Thus, when an external force acts downward on the housing 10, the support portions 10*g* abut against the substrate 7 so that a downward rotational moment generated in the housing 10 can be alleviated. This can reduce a possibility that the connector pins 8 separate from the connection terminals 2.

More specifically, when an external force acts downward on the housing 10, a downward rotational moment is caused on the housing 10 about the pinching portion 8*e* which is a joining portion between the substrate 7 and the connector 31. As a result, an upward rotational moment is caused on the support portions 10*g* so that the support portions 10*g* rotate. Then, the support portions 10*g* abut against the substrate 7 so that the rotational moment generated in the support portions 10*g* is alleviated. By virtue of this, the downward rotational moment generated in the housing 10 is alleviated. This can reduce a possibility that the connector 31 rotates, and reduce a possibility that the connector pins 8 separate from the connection terminals 2.

Further, the protrusion length of the support portion 10*g* from the housing 10 is longer than the protrusion length of the second connector pin 8*b* from the housing 10. By virtue of this, even when an external force acts on the housing 10 so that a downward rotational moment is caused, the support portions 10*g* easily abut against the substrate 7. As a result, the downward rotational moment generated in the housing 10 is alleviated and hence a possibility of rotation of the connector 31 can be reduced.

The thermal head X1 has a configuration that the housing 10 has a box shape and the support portions 10*g* are disposed on the side walls 10*c* located in both end portions of the housing 10 in the main scanning direction. Thus, the support portions 10*g* abut against the substrate 7 in both end portions of the housing 10 in the main scanning direction.

As a result, when one support portion 10*g* abuts against the substrate 7, upward rotation of the housing 10 about the one support portion 10*g* is suppressed by a situation that the other support portion 10*g* abuts against the substrate 7. By virtue of this, a possibility of vertical inclination of the housing 10 can be reduced.

Further, the thermal head X1 has a configuration that the substrate 7 and the support portion 10*g* are apart from each other and the space 14 is provided between the substrate 7 and the support portion 10*g*. Thus, in this configuration, even when thermal expansion occurs in the support portion 10*g*, the substrate 7 is not affected. This can ensure flatness in the substrate 7.

The connector 31 and the head base 3 are fixed together by the connector pins 8, a jointing material 23, and the covering member 12. As shown in FIGS. 1 and 2, the connector pins 8 are disposed on the connection terminal 2 of the ground electrode 4 and the connection terminals 2 of the first connecting electrodes 21. As shown in FIG. 2, the connection terminal 2 and the connector pin 8 are mechanically and electrically connected together by the jointing material 23. Then, the covering member 12 is disposed so as to cover the first connector pin 8*a* of the connector 31 and the head base 3 connected by the jointing material 23.

Examples of the jointing material 23 include solder, and anisotropy electrically conductive adhesives wherein conductive particles are mixed into an electrically insulating resin. The present embodiment is described for a case where solder is employed. The connector pin 8 is covered by the jointing material 23 and thereby electrically connected to the connection terminal 2. Instead, a plating layer (not shown) composed of Ni, Au, or Pd may be provided between the jointing material 23 and the connection terminal 2.

For example, the covering member 12 may be formed from an epoxy-based thermosetting resin, an ultraviolet-curing resin, or a visible-light curing resin.

Next, description is given for joining between the connector 31 and the head base 3 in a case where the covering member 12 is formed of a thermosetting resin.

First, in the thermal head X1, the head base 3 is inserted between the first connector pin 8*a* and the second connector pin 8*b*. At that time, the support portion 10*g* serves as a guide for guiding a path of the head base 3. The head base 3 is inserted up to the positioning portion 10*f* of the housing 10. The first connector pin 8*a* is disposed on the connection terminal (not shown).

Next, the jointing material 23 is applied on each first connector pin 8*a* so that the connector pin 8 and the head base 3 are connected together by the jointing material 23. Then, the head base 3 to which the connector 31 has been joined is placed on the heat radiating plate 1 on which a double-sided tape or the like has been provided. Then, the covering member 12 is printed or applied by using a dispenser such that the first connector pin 8*a* may be covered. Then, the covering member 12 is cured so that the thermal head X1 can be fabricated.

The covering member 12 is disposed on the upper faces of the first connector pin 8*a*, the upper wall 10*a* of the housing 10, the support portion 10*g*, and the head base 3. By virtue of this, the first connector pin 8*a* can be sealed. Further, even when an external force acts upward on the connector 31, the covering member 12 has a function of alleviating the upward rotational moment generated in the connector 31 so as to reduce a possibility of rotation of the connector 31.

Further, the covering member 12 is disposed between adjacent connector pins 8. This can suppress displacement of the connector 31 in the main scanning direction. Further, the covering member 12 is disposed between the side wall 10*c* and the connector pin 8. This can suppress displacement of the connector 31 in the main scanning direction.

Further, the covering member 12 is disposed in the space 14 surrounded by the support portion 10*g* and the substrate 7. The covering member 12 disposed in the space 14 is formed on the lower face of the head base 3. By virtue of this, the joining area between the substrate 7 and the housing 10 can be increased so that the joining strength between the head base 3 and the housing 10 can be improved.

Further, even when an external force acts on the housing 10 so that an upward rotational moment acts on the support portion 10*g*, since the covering member 12 is disposed in the space 14, the pressing force acting from the support portion 10*g* can be alleviated so that a possibility of damage of the head base 3 or the support portion 10*g* can be reduced. Even in this case, a reaction caused by the support portion 10*g* pressing the covering member 12 acts on the support portion 10*g* so that the upward moment generated in the support portion 10*g* can be alleviated.

Further, the covering member 12 is disposed in a space 16 between the connector pin 8 and the head base 3. By virtue of this, the joining area between the head base 3 and the housing 10 can be increased so that the joining strength between the head base 3 and the housing 10 can be improved.

Further, the covering member 12 is arranged in a space 18 surrounded by the substrate 7, the support portion 10*g*, and the second connector pin 8*b* adjacent to the support portion 10*g*. By virtue of this, the joining strength between the substrate 7 and the support portion 10*g* can be improved. Further, even when an external force acts on the housing 10 in the right or left direction, the rightward or leftward rotational moment generated in the housing 10 can be alleviated by virtue of the covering member 12 arranged in the space 18.

Further, the covering member 12 disposed in the space 18 has a shape tapered from the tip of the second connector pin 8*b* toward the housing 10. In other words, the amount of the covering member 12 arranged in the surroundings of the second connector pin 8*b* gradually increases as going from the protruding tip of the second connector pin 8*b* toward the housing 10.

Thus, even when an external force acts on the housing 10 in the main scanning direction, a possibility that the housing 10 is displaced in the main scanning direction can be reduced by virtue of the covering member 12 disposed in the space 16.

Further, the support portion 10*g* is disposed adjacent to the side surface 1*b* of the heat radiating plate 1*a* and then the support portion 10*g* is apart from the side surface 1*b*. Thus, even when thermal expansion occurs in the support portion 10*g*, a possibility of coming into contact with the heat radiating plate 1 can be reduced. This can reduces a possibility of occurrence of substrate deviation that the substrate 7 joined to the connector 31 deviates from the heat radiating plate 1.

Here, in the example given above, the support portion 10*g* has been provided in the side wall 10*c*. However, the support portion 10*g* need not necessarily be provided in the side wall 10*c*. The substrate 7 and the support portion 10*g* may be not apart from each other. The covering member 12 may be not disposed between the substrate 7 and the support portion 10*g*.

Next, a thermal printer Z1 is described below with reference to FIG. 8.

Figure 8:
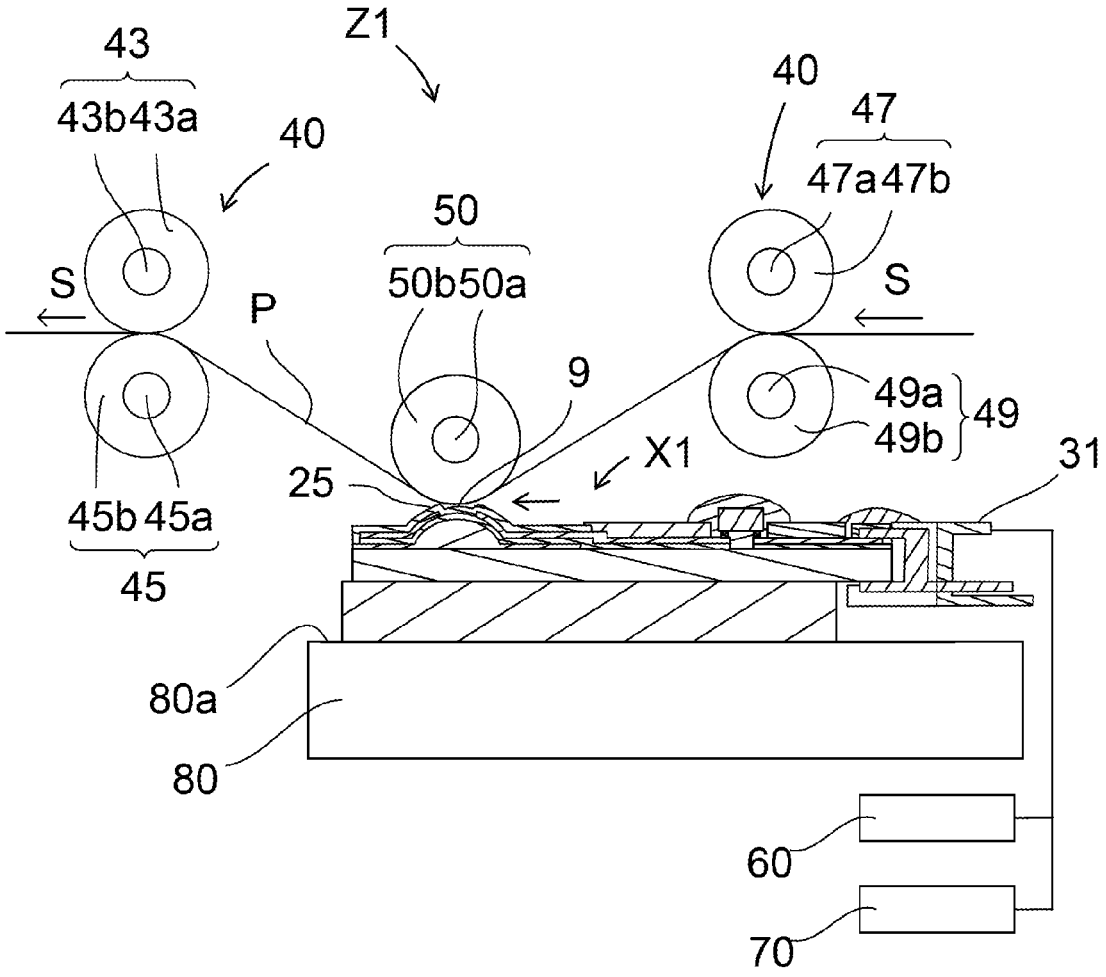
FIG. 8 is a schematic diagram showing a thermal printer according to the first embodiment.

As shown in FIG. 8, the thermal printer Z1 of the present embodiment includes the above-mentioned thermal head X1, a conveying mechanism 40, a platen roller 50, a power supply device 60, and a control device 70. The thermal head X1 is attached to an attaching surface 80*a* of a mounting member 80 is provided in a housing (not shown) of the thermal printer Z1. Here, the thermal head X1 is attached to the mounting member 80 along the main scanning direction defined as a direction perpendicular to the conveyance direction S of a recording medium P described later.

The conveying mechanism 40 includes a drive portion (not shown) and conveying rollers 43, 45, 47, and 49. The conveying mechanism 40 has a function of conveying in a direction of arrow S of FIG. 8 the recording medium P such as thermal paper and image receiving paper onto which ink is to be transferred and thereby conveying the recording medium P onto the protection layer 25 located on the plurality of heat generating portions 9 of the thermal head X1. The drive portion has a function of driving the conveying rollers 43, 45, 47, and 49 and, for example, may be constructed from a motor. For example, the conveying rollers 43, 45, 47, and 49 may be constructed such that shafts 43*a*, 45*a*, 47*a*, and 49*a* each having a cylindrical shape and fabricated from metal such as stainless steel are covered by elastic members 43*b*, 45*b*, 47*b*, and 49*b* fabricated from butadiene rubber or the like. Here, although not shown in the figure, in a case where the recording medium P is constructed from image receiving paper onto which ink is to be transferred, an ink film, together with the recording medium P, is conveyed at a position between the recording medium P and heat generating portion 9 of the thermal head X1.

The platen roller 50 has a function of pressing the recording medium P onto a protective film 25 located on the heat generating portion 9 of the thermal head X1. The platen roller 50 is disposed such as to extend along a direction perpendicular to the conveyance direction S of the recording medium P. Further, both end portions of the platen roller 50 are rotatably supported and fixed in a state where the recording medium P is pressed onto the heat generating portion 9. For example, the platen roller 50 may be constructed such that a shaft 50*a* having a cylindrical shape and fabricated from metal such as stainless steel is covered by an elastic member 50*b* fabricated from butadiene rubber or the like.

The power supply device 60 has a function of providing an electric current for causing the heat generating portion 9 of the thermal head X1 to generate heat as described above and an electric current for causing the drive IC 11 to operate. The control device 70 has a function of supplying to the drive IC 11 a control signal for controlling the operation of the drive IC 11 for the purpose of selectively causing each heat generating portion 9 of the thermal head X1 to generate heat as described above.

As shown in FIG. 8, in the thermal printer Z1, in a state where the platen roller 50 presses the recording medium P onto the heat generating portion 9 of the thermal head X1 and in a state where the recording medium P is conveyed on the heat generating portion 9 by the conveying mechanism 40, the power supply device 60 and the control device 70 selectively cause each heat generating portion 9 to generate heat so that predetermined image-printing is performed on the recording medium P. Here, in a case where the recording medium P is image receiving paper or the like, ink of an ink film (not shown) conveyed together with the recording medium P is thermal-printed to the recording medium P so that image printing is achieved in the recording medium P.

<Second Embodiment>

Figure 9:
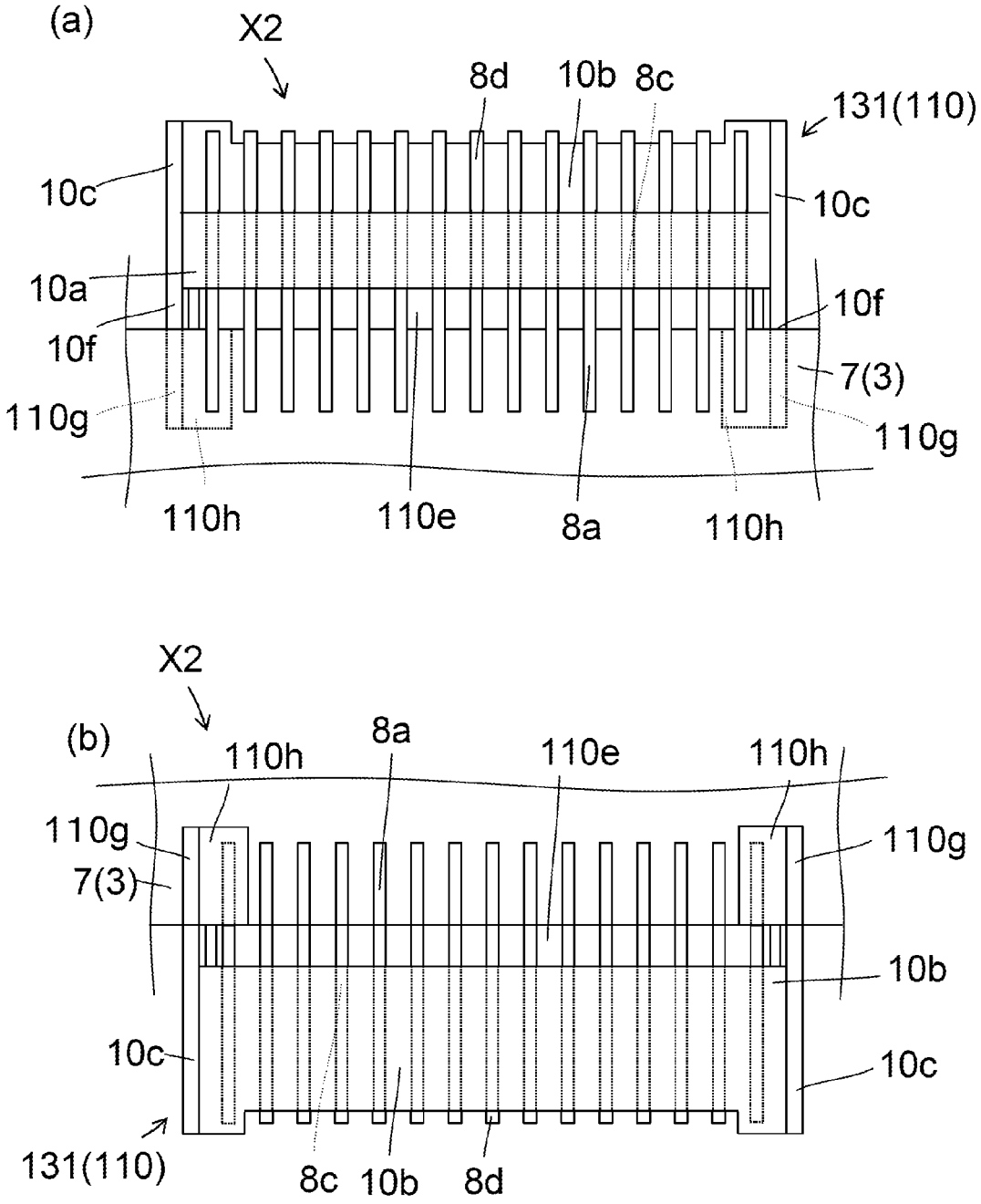
FIG. 9 shows an enlarged view of a vicinity of a connector constituting a thermal head according to a second embodiment, wherein FIG. 9(*a*) is a plan view, and FIG. 9(*b*) is a bottom view.
Figure 10:
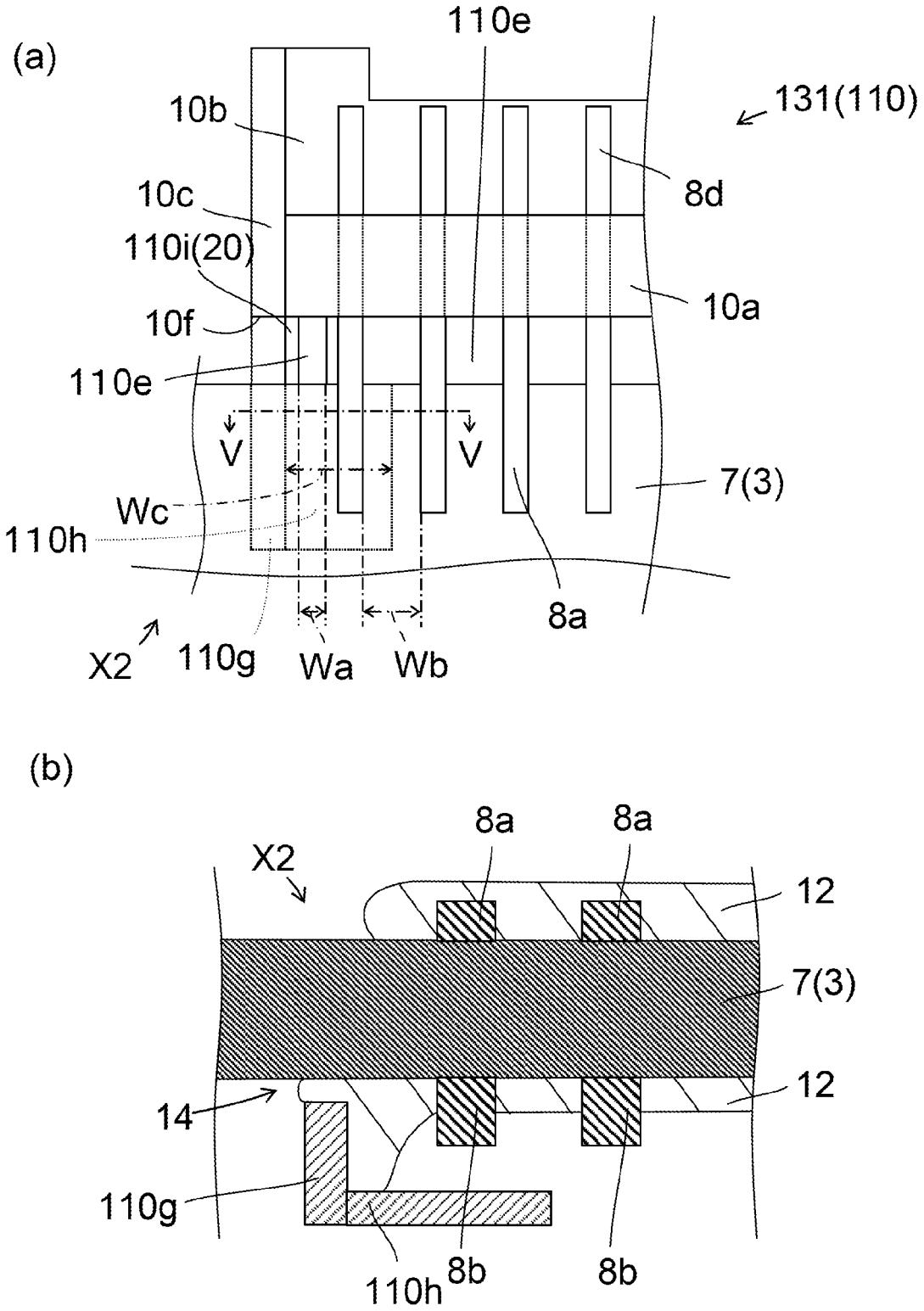
FIG. 10(*a*) is an enlarged plan view showing a vicinity of the connector constituting the thermal head according to the second embodiment, and FIG. 10(*b*) is a sectional view taken along the line V-V shown in FIG. 10(*a*)

A thermal head X2 is described below with reference to FIGS. 9 and 10. Here, like members to those of the thermal head X1 are designated by like numerals. This convention is adopted throughout the following description.

A housing 110 includes an upper wall 10*a*, a lower wall 10*b*, side walls 10*c*, a front wall (not shown), and support portions 110*g*, and further includes a protruding portion 110*e*, a cutout portion 110*i*, and a damming portion 110*h*. The protruding portion 110*e* is disposed between adjacent connector pins 8 in a plan view. Further, the protruding portion 110*e* is arranged also between the side wall 10*c* and the connector pin 8. The protruding portion 110*e* extends from the front wall of the housing 10 to the head base 3 side.

The thermal head X2 has a configuration that the housing 110 includes the protruding portion 110*e* protruding toward a space between adjacent first connector pins 8*a* in a plan view. The protruding portion 110*e* makes it possible to reduce a possibility that the covering member 12 flows out downward when the covering member 12 is applied from the upper wall 10*a* side.

That is, the protruding portion 110*e* dams up the covering member 12 so that the covering member 12 can be stopped in the upper portion of the housing 110. As a result, a possibility of shortage of the covering member 12 in the upper portion of the housing 110 can be reduced so that the connector pins 8 can be sealed.

Further, the protruding portion 110*e* adjacent to the side wall 10*c* is provided with the cutout portion 110*i*. Thus, a space 20 is formed between the side wall 10*c* and the adjacent protruding portion 110*e* in a plan view. Thus, the thermal head X2 has a configuration that the width Wa of the protruding portion 110*e* adjacent to the side wall 10*c* is narrower than the width Wb of the protruding portion 110*e* disposed between adjacent first connector pins 8*a*.

Thus, when the covering member 12 is applied, a part of the covering member 12 flows out downward though the space 20. The covering member 12 having flowed downward spreads along the support portion 110*g* and is then arranged in the surroundings of the support portion 110*g*. As a result, the covering member 12 can be arranged in the surroundings of the support portion 110*g* and hence the joining strength between the support portion 110*g* and the head base 3 can be improved. This reduces a possibility that the connector pins 8 separate from the connection terminals 2 (see FIG. 1).

It is preferable that the width (the length in the main scanning direction) of the cutout portion 110*i* is 0.1 to 0.3 mm. Then, while the covering member 12 is restrained from flowing out downward, the first connector pins 8*a* can be sealed by the covering member 12.

It is preferable that the width Wa of the protruding portion 110*e* is 50% to 100% of the width Wb of the protruding portion 110*e*. Then, while a possibility that the covering member 12 flows out downward is reduced, the joining strength between the connector 31 and the substrate 7 in both end portions in the main scanning direction can be improved.

Further, the support portion 110*g* includes the damming portion 110*h*. The damming portion 110*h* protrudes from the support portion 110*g* toward the center portion in the main scanning direction and is then connected to the lower end of the support portion 110*g*. Thus, the support portion 110*g* and the damming portion 110*h* form an L-shape in sectional view as shown in FIG. 10(*b*).

In the thermal head X2, the support portion 110*g* includes the damming portion 110*h*. Thus, the covering member 12 having flowed out from above can be dammed up by the damming portion 110*h* and hence a possibility that the covering member 12 flow out to the outside of the connector 31 can be reduced. This can reduce a possibility of shortage in the amount of the covering member 12.

That is, as for the covering member 12 having flowed out from the upper face of the housing 110, a part thereof is disposed in the space 14 and an another part thereof is disposed on the damming portion 110*h*. As a result, the joining strength between the support portion 110*g* and the substrate 7 can be improved, and the joining strength between the damming portion 110*h* and the substrate 7 can also be improved.

Further, it is preferable that the width Wc of the damming portion 110*h* is wider than the width Wa of the protruding portion 110*e*. By virtue of this, the covering member 12 having flowed out from the space 20 can be dammed up by the damming portion 110*h* so that outflow of the covering member 12 can be suppressed.

Further, it is preferable that the width Wc of the damming portion 110*h* is wider than the width Wb of the protruding portion 110*e*. That is, it is preferable that the width Wc of the damming portion 110*h* is wider than the interval between the side wall 10*c* and the connector pin 8. By virtue of this, the covering member 12 having flowed out from the space 20 can reliably be dammed up by the damming portion 110*h* so that outflow of the covering member 12 can be suppressed.

Here, description has been given for an example that the width of the cutout portion 110*i* is shortened. Instead, the protrusion length of the cutout portion 110*i* may be shortened. Even in this case, the covering member 12 can be supplied downward though the space 20.

<Third Embodiment>

A thermal head X3 is described below with reference to FIG. 11. In the thermal head X3, the shape of a connector 231 is different from a connector 131 of the thermal head X2. The other points are similar to those of the connector 131 and hence their description is omitted.

In a housing 210, all of protruding portions 210*e* are provided with cutout portions 210*i*. The cutout portions 210*i* are provided on both sides of the protruding portion 210*e* in the main scanning direction. The cutout portions 210*i* are individually provided on the substrate 7 side. Thus, a space 20 is formed between the substrate 7 and the protruding portion 210*e*.

Even in such a case, when the covering member 12 is applied, a part of the covering member 12 flows out downward though the space 20. By virtue of this, the covering member 12 can be supplied between the substrate 7 and the protruding portion 210*e* so that the connection strength between the substrate 7 and the housing 210 can be improved.

Further, the cutout portion 210*i* is provided in a state of being inclined relative to the connector pin 8 in a plan view. By virtue of this, the covering member 12 can efficiently be supplied to the space 16 between the substrate 7 and the connector pin 8 so that the connection strength between the substrate 7 and the housing 210 can be improved.

Further, in the thermal head X3, the tip of the support portion 210*g* abuts against the side surface 1*b* of the heat radiating plate 1. This can reduce a possibility that a frictional force caused by contact with the recording medium (not shown) acts on the substrate 7 so that the substrate 7 deviates from the heat radiating plate 1.

Figure 11:
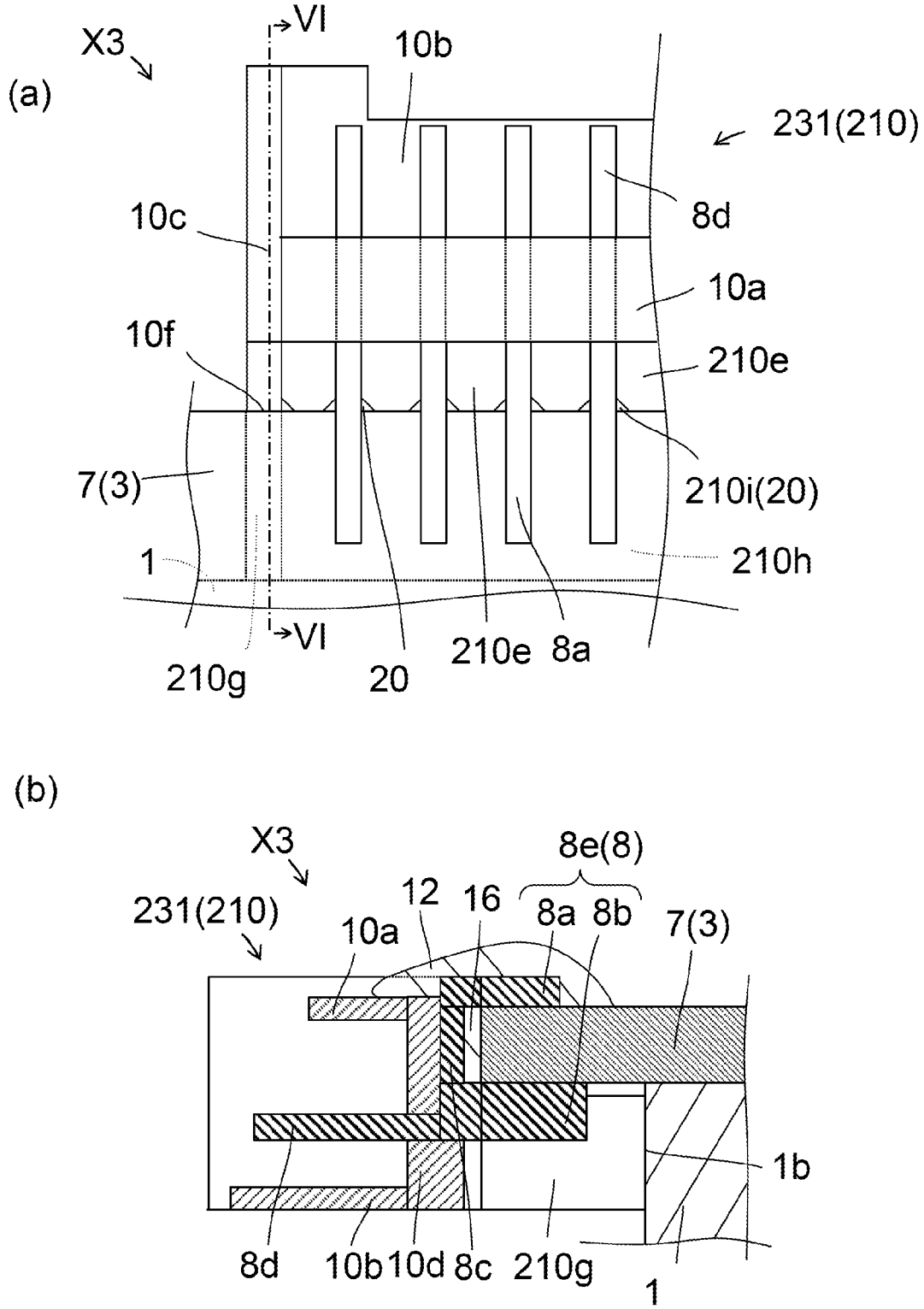
FIG. 11(*a*) is an enlarged plan view showing a vicinity of a connector constituting a thermal head according to a third embodiment, and FIG. 11(*b*) is a sectional view taken along the line VI-VI shown in FIG. 11(*a*)

That is, when the substrate 7 comes into contact with the recording medium, a frictional force generated in the substrate 7 acts rightward in FIG. 11(*b*). However, by virtue of a configuration that the support portion 210*g* abuts against the side surface 1*b*, rightward displacement of the substrate 7 can be suppressed and hence a possibility of deviation of the substrate 7 from the heat radiating plate 1 can be reduced.

<Fourth Embodiment>

Figure 15:
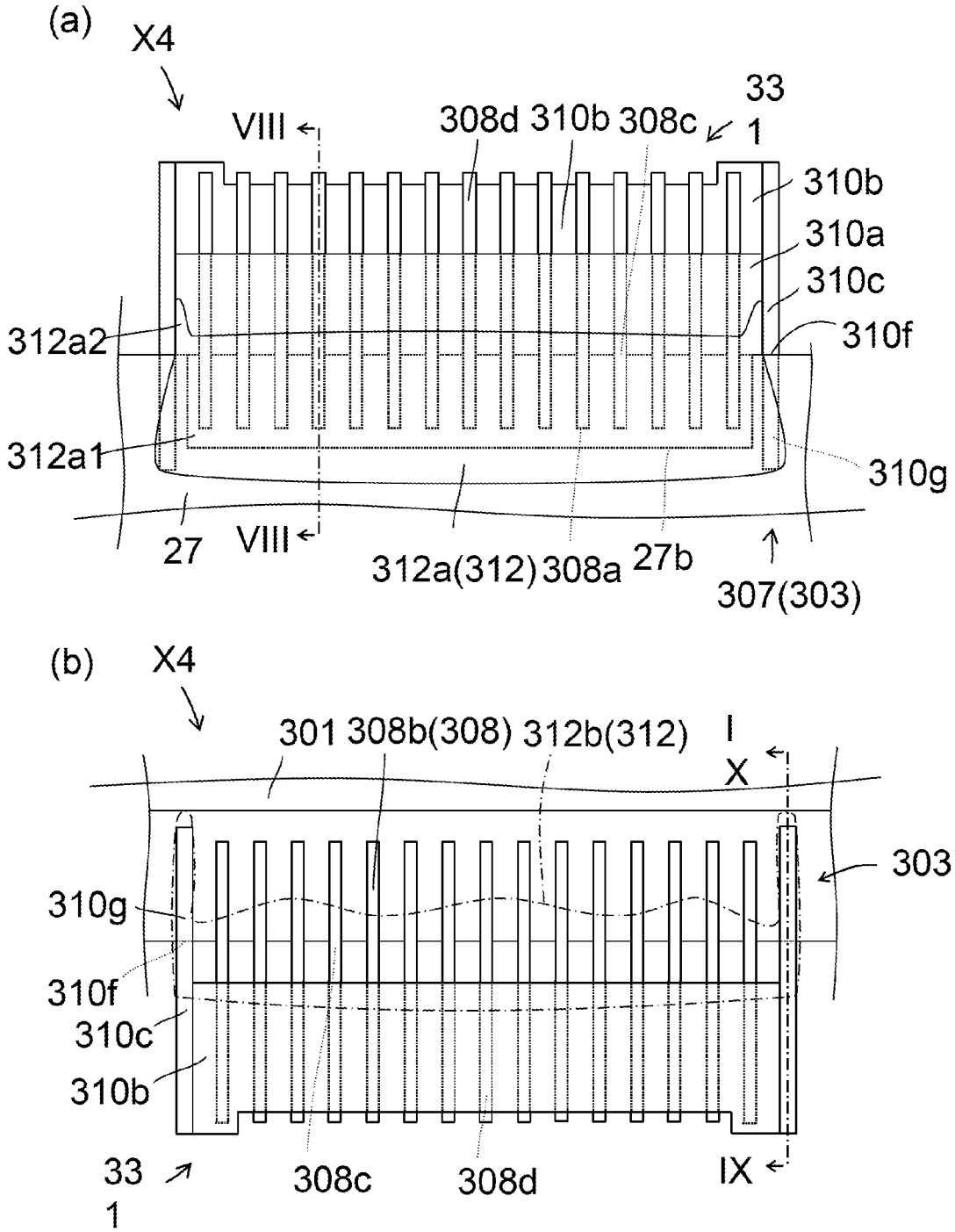
FIG. 15 shows an enlarged view of a vicinity of the connector constituting the thermal head according to the fourth embodiment, wherein FIG. 15(*a*) is a plan view, and FIG. 15(*b*) is a bottom view.
Figure 16:
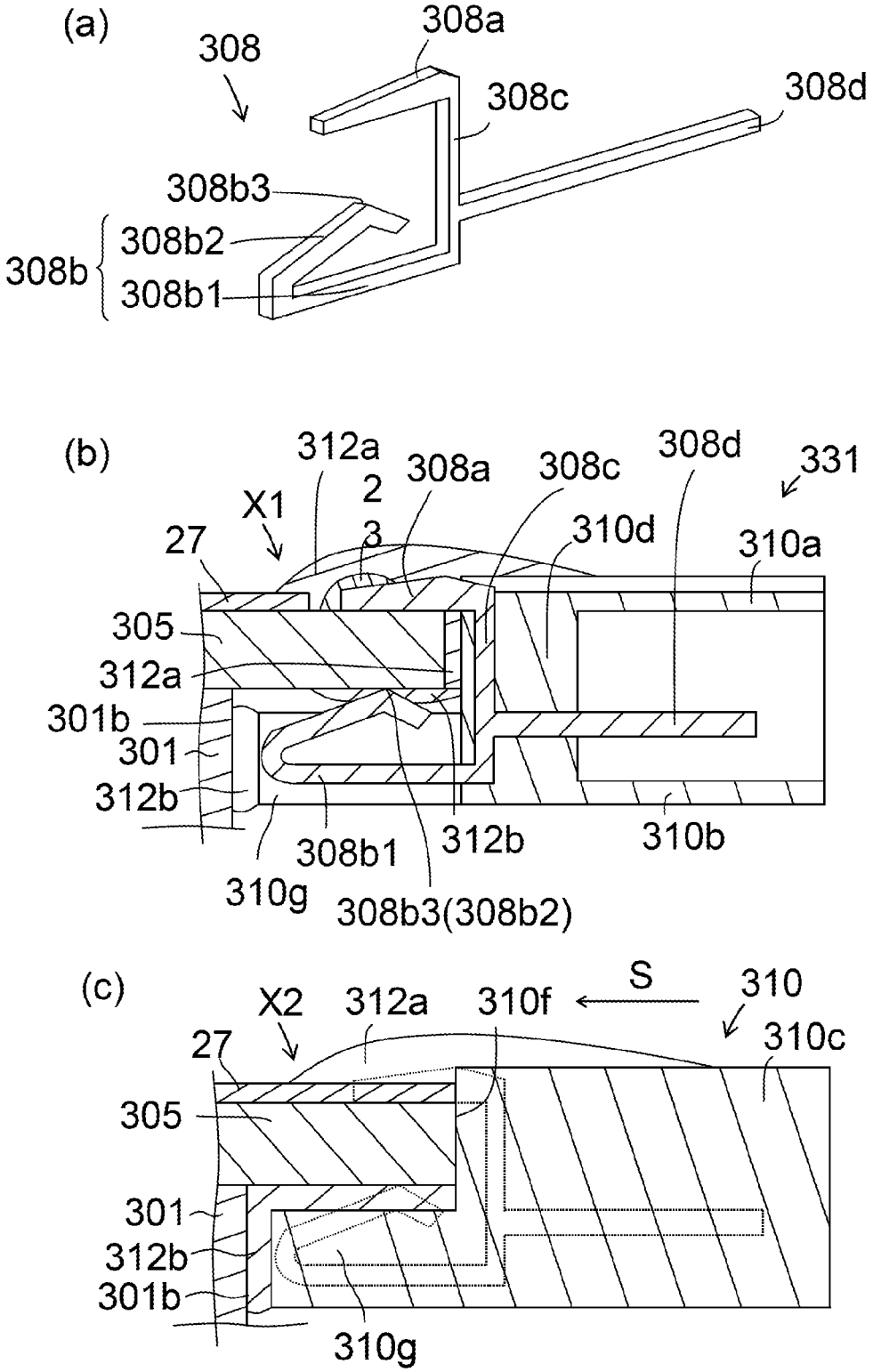
FIG. 16(*a*) is a perspective view of a connector pin of the connector constituting the thermal head according to the fourth embodiment, wherein FIG. 16(*b*) is a sectional view taken along the line VIII-VIII shown in FIG. 15(*a*), and FIG. 16(*c*) is a sectional view taken along the line IX-IX shown in FIG. 15(*b*).

A thermal head X4 is described below with reference to FIGS. 12 to 16. Here, FIG. 12(*a*) schematically shows the configuration of a head base 303, a wiring board 305, and a connector 331. Then, a coating resin 329 is not shown in the figure. In FIG. 15(*b*), the dash-dotted line indicates a second covering member 320.

The thermal head X4 includes a heat radiating plate 301, a head base 303, a wiring board 305, and a connector 331. Although not shown in FIG. 12(*a*), individual members for causing a heat generating portion 9 to generate heat are provided.

In the wiring board 305, wirings (not shown) are provided and the wirings are electrically connected to various electrodes of the head base 303. A plurality of drive ICs 311 are disposed on the wiring board 305. Each drive IC 311 is electrically connected to various electrodes of the head base 303 through wires and electrically connected to wirings of the wiring board 305 through wires.

Figure 12:
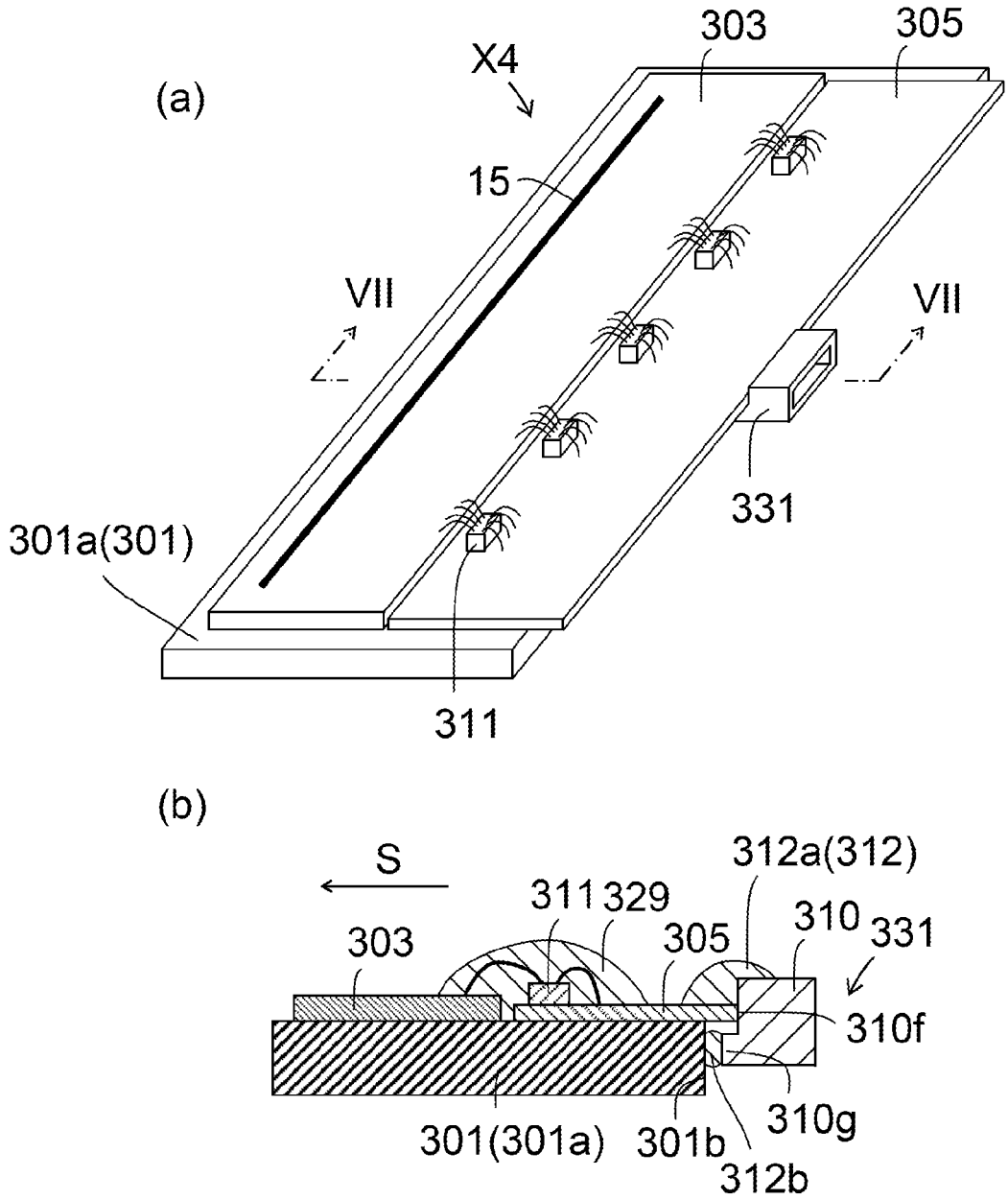
FIG. 12 shows a thermal head according to a fourth embodiment, FIG. 12(*a*) is a schematic perspective view, and FIG. 12(*b*) is a sectional view taken along the line VII-VII shown in FIG. 12(*a*)
Figure 13:
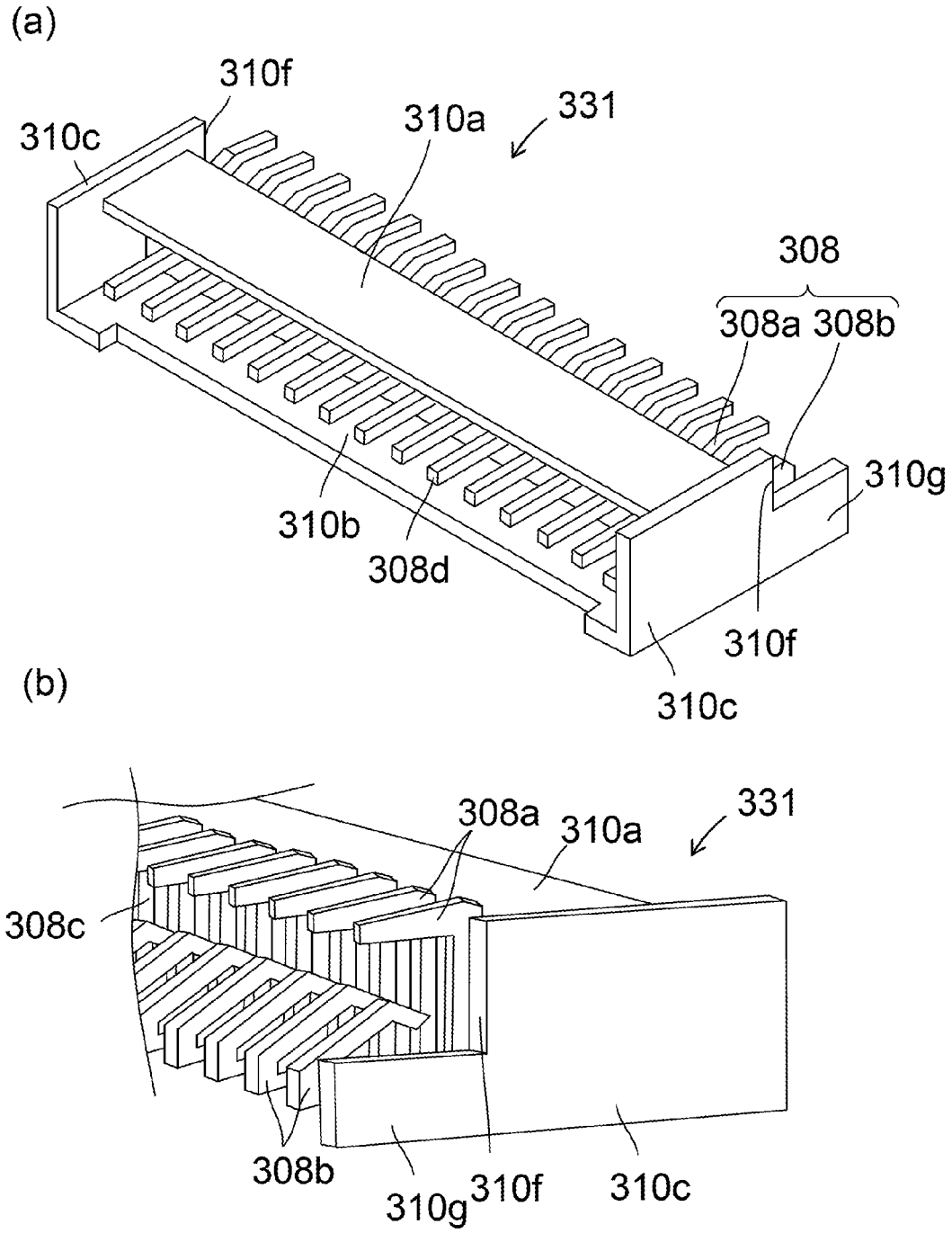
FIG. 13(*a*) is a perspective view of a connector constituting the thermal head according to the fourth embodiment, and FIG. 13(*b*) is an enlarged perspective view seen from another direction.
Figure 14:
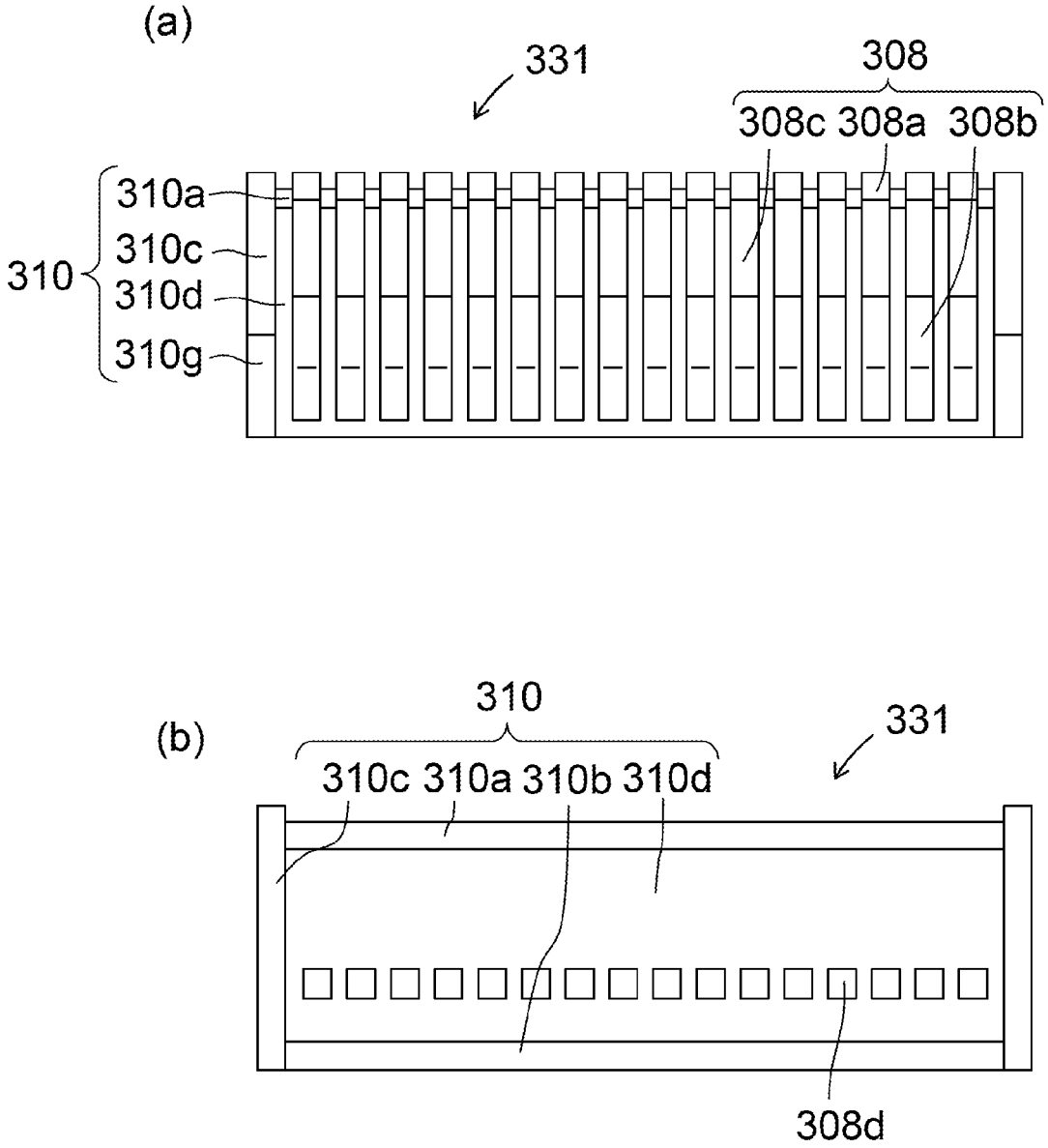
FIG. 14 shows a perspective view of the connector constituting the thermal head according to the fourth embodiment, wherein FIG. 14(*a*) is a front view, and FIG. 14(*b*) is a rear view.

As shown in FIG. 12(*b*), the coating resin 329 is disposed so as to cover the drive IC 311 and covers a part of the head base 303, the drive IC 311, and a part of the wiring board 305. Thus, the head base 303 and the wiring board 305 are joined together by the coating resin 329.

Further, in the wiring board 305, the connector 331 is provided in the center portion thereof in the main scanning direction. Connector pins 308 (see FIG. 13) of the connector 331 are electrically connected to the wirings of the wiring board 305. Then, each connector pin 308 is joined by a covering member 312. Here, although not shown in the figure, the connector pin 308 and the wiring is joined by the jointing material 23 similarly to the configuration of the thermal head X1. Thus, the head base 303, the wiring board 305, and the connector 331 are integrated together by the jointing material 23 and the covering member 312.

The connector 331 includes a plurality of the connector pins 308 and a housing 310 for containing the plurality of connector pins 308. Then, the housing 310 is disposed adjacent to the wiring board 305 in the sub-scanning direction and has support portions 310*g* disposed under the wiring board 305.

Thus, even when an external force acts downward on the housing 310, the support portions 310*g* abut against the wiring board 305 so that the upward rotational moment generated in the housing 310 can be alleviated. This can reduce a possibility that the connector pins 308 separate from the wirings.

The connector pin 308 includes a first connector pin 308*a*, a second connector pin 308*b*, a third connector pin 308*c*, and a fourth connector pin 308*d*. In the connector pin 308, the first connector pin 308*a* to the fourth connector pin 308*d* are formed in an integrated manner.

The first connector pin 308*a* is disposed on the wiring of the wiring board 305. The second connector pin 308*b* is disposed under the wiring board 305. Then, the first connector pin 308*a* and the second connector pin 308*b* pinch the wiring board 305. The third connector pin 308*c* links together the first connector pin 308*a* and the second connector pin 308*b*, and is disposed so as to extend in the thickness direction of the wiring board 305. The fourth connector pin 308*d* is drawn out in a direction of traveling away from the wiring board 305 and joined to the housing 310.

The second connector pin 308*b* includes a first portion 308*b*1 and a second portion 308*b*2. The first portion 308*b*1 extends in a direction of traveling away from the third connector pin 308*c*. The second portion 308*b*2 is provided so as to be continuous to the first portion 308*b*1 and extends in a direction of approaching the third connector pin 308*c*, in an inclined manner relative to the first portion 308*b*1. Further, the second portion 308*b*2 includes a contact portion 308*b*3, and the contact portion 308*b*3 is in contact with the substrate 307.

Thus, in the second connector pin 308*b*, the first portion 308*b*1 and the second portion 308*b*2 are formed so as to be continuous to each other and the connection region between the first portion 308*b*1 and the second portion 308*b*2 has a warped shape. By virtue of this, when the wiring board 305 is inserted, the second connector pin 308*b* is elastically deformed so that the wiring board 305 is pinched by the first connector pin 308*a* and the second connector pin 308*b*.

The second connector pin 308*b* protrudes from the wiring board 305 beyond the first connector pin 308*a*. Further, the contact portion 308*b*3 is disposed on the third connector pin 308*c* side relative to the tip of the first connector pin 308*a*.

Thus, when the wiring board 305 is inserted into the connector 331, the wiring board 305 comes into contact with the second connector pin 308*b* before coming into contact with the first connector pin 308*a*. As a result, it is possible to reduce a possibility that, in the course of insertion of the wiring board 305, the first connector pin 308*a* comes into contact with the wiring board 305 so that the wiring is scraped by the first connector pin 308*a*. By virtue of this, a possibility that the first connector pin 308*a* damages the wiring provided on the wiring board 305 can be reduced and hence electrical connection of the thermal head X4 to the outside can be ensured.

Further, the contact portion 308*b*3 is arranged on the third connector pin 308*c* side relative to the tip of the first connector pin 308*a*. Thus, the first connector pin 308*a* and the contact portion 308*b*3 can pinch the wiring board 305 so that the mechanical connection between the wiring board 305 and the connector 331 can be made firmer.

Further, since the second portion 308*b*2 includes the contact portion 308*b*3, the second connector pin 308*b* is configured to be elastically deformable. By virtue of this, at the time of insertion of the wiring board 305, the second connector pin 308*b* is deformed downward, and hence the wiring board 305 can be inserted in a state where the first connector pin 308*a* and the wiring board 305 are apart from each other. This can reduce a possibility that the wirings of the wiring board 305 are damaged.

Further, the second connector pin 308*b* is configured to be elastically deformable. Thus, even when an external force in the vertical direction acts on the housing 310, the second connector pin 308*b* can be deformed so as to absorb the external force. By virtue of this, the rotational moment generated in the housing 310 can be alleviated and hence it is possible to reduce a possibility that the first connector pin 308*a* separates from the wiring.

As shown in FIGS. 15(*a*) and 15(*b*), in the thermal head X4, the covering member 312 includes a first covering member 312*a* and a second covering member 312*b*. The first covering member 312*a* is provided on the first connector pin 308*a*. The second covering member 312*b* is disposed on the second connector pin 308*b*. The first covering member 312*a* is disposed so as to cover the first connector pin 308*a*. The second covering member 312*b* is disposed so as to expose a part of the second connector pin 308*b*. Then, the hardness of the second covering member 312*b* is lower than the hardness of the first covering member 312*a*.

For example, the first covering member 312*a* may be formed of an epoxy-based thermosetting resin. Then, it is preferable that the epoxy-based thermosetting resin has a Shore D hardness of D80 to D100. Further, it is preferable that the thermal expansion coefficient is 10 to 20 ppm at ordinary temperatures.

For example, the second covering member 312*b* may be formed of an epoxy-based thermosetting resin. Then, it is preferable that the epoxy-based thermosetting resin has a Shore D hardness of D60 to D80. Further, it is preferable that the thermal expansion coefficient is 60 to 100 ppm at ordinary temperatures.

Here, for example, the hardnesses of the first covering member 312*a* and the second covering member 312*b* can be measured by using a durometer (type D) of JIS K 6253. For example, measurement by using the durometer may be performed at three arbitrary points in the first covering member 312*a*, and then the average thereof may be adopted as the hardness of the first covering member 312*a*. Here, a similar method may be employed also for the hardness of the second covering member 312*b*. Further, in place of the durometer, the measurement may be performed by using a Shore hardness meter or the like.

Here, in the thermal head X4, the first connector pin 308*a* is electrically and mechanically connected to the wiring by the jointing material 23. In contrast, the second connector pin 308*b* is merely in contact with the substrate 7 through the contact portion 308*b*3 and hence has merely a lower joining strength with the wiring board 305 in comparison with the first connector pin 308*a*.

Further, in the connector pin 308, in some cases, heat generated at the time of drive of the thermal head X4 causes thermal expansion in the housing 310 and hence deformation may be caused in the connector pin 308. At that time, since the first connector pin 308*a* is fixed to the wiring by the jointing material 23, in this configuration, the second connector pin 308*b* is easily deformed. Thus, in some cases, separation may occur in the second covering member 312*b* located in the surroundings of the second connector pin 308*b*.

In contrast, the thermal head X4 has such a configuration that the hardness of the second covering member 312*b* is lower than the hardness of the first covering member 312*a*. Thus, even when thermal expansion occurs in the connector pin 308, since the hardness of the second covering member 312*b* located in the surroundings of the second connector pin 308*b* is lower than the hardness of the first covering member 312*a*, the second covering member 312*b* can follow the deformation of the second connector pin 308*b*.

As a result, the stress generated in the inside of the second covering member 312*b* can be alleviated and hence a possibility that separation occurs in the second covering member 312*b* can be reduced. Accordingly, the joining strength of the connector 331 can be ensured. Thus, a possibility that the connector 331 separates from the wiring board 305 can be reduced.

Further, in the thermal head X4, the first covering member 312*a* covers the first connector pin 308*a*, and the second covering member 312*b* is disposed on the second connector pin 308*b* in a state where a part of the second connector pin 308*b* is exposed. Thus, the deformation of the second connector pin 308*b* is less likely to be blocked, and hence the stress generated in the second covering member 312*b* can be alleviated.

Here, electrical connection of the thermal head X4 to the outside is achieved by attaching and detaching a socket to and from the opening portion of the housing 310. At the time of attaching and detaching of the socket, an external force acts on the housing 310 in the thickness direction, the sub-scanning direction, or the main scanning direction. Thus, a possibility arises that the housing 310 is damaged. In particular, when the socket is extracted from the housing 310, a strong external force easily acts on the housing 310 in the main scanning direction.

In contrast, in the thermal head X4, as shown in FIG. 15(*a*), the first covering member 312*a* includes: a first portion 312*a*1 disposed on the housing 310; and a second portion 312*a*2 protruding from the first portion 312*a*1 in a direction of traveling away from the wiring board 305 in a plan view.

Thus, the thickness of the upper face 310*a* of the housing 310 can be reinforced by the thickness of the second portion 312*a*2. As a result, the second portion 312*a*2 can reinforce the housing 310. Thus, even when an external force acts on the housing 310, a possibility that the housing 310 is damaged can be reduced. As a result, a possibility that the connector 331 is damaged can be reduced.

Further, the thermal head X4 has such a configuration that each end portion of the housing 310 in the main scanning direction is provided with the second portion 312*a*2. Thus, the second portion 312*a*2 can reinforce each end portion of the housing 310 in the main scanning direction. Thus, when the socket is extracted from the housing 310, a possibility that the housing 310 is damaged can be reduced.

The second covering member 312*b* is disposed on the second connector pin 308*b* and disposed so as to extend in the main scanning direction. The second covering member 312*b* is disposed so as to cover the contact portion 308*b*3 of the second connector pin 308*b* and is disposed in a state where the first portion 308*b*1 of the second connector pin 308*b* is exposed.

Further, the second covering member 312*b* is disposed between the support portion 310*g* and the wiring board 305.

By virtue of this, the joining strength between the wiring board 305 and the connector 331 can be improved.

Further, the second covering member 312*b* is disposed between the support portion 310*g* and the heat radiating plate 301 and the housing 310 abuts against the heat radiating plate 301. That is, in the thermal head X4, the housing 310 is arranged adjacent to the side surface 301*e* of the heat radiating plate 310 and the support portion 310*g* and the side surface 301*e* are connected together by the second covering member 312*b*.

By virtue of this, even when a frictional force acts on the head base 303 in accordance with conveyance of the recording medium, since the housing 310 abuts against the heat radiating plate 301, a possibility of occurrence of position deviation of the head base 303 can be reduced.

Further, the housing 310 is in contact with the side surface 301*b* of the heat radiating plate 301 with the second covering member 312*b* in between. Thus, in the main scanning direction, position deviation of the housing 310 from the heat radiating plate 301 is less likely to occur. Thus, even when an external force acts on the housing 310, a possibility of position deviation of the housing 310 in the main scanning direction can be reduced.

Further, the second covering member 312*b* joins together the support portion 310*g* and the side surface 301*b*. This can reduce an internal stress in the housing 310 caused by a difference in the thermal expansion coefficients of the housing 310 and the heat radiating plate 301. By virtue of this, the amount of deformation generated in the housing 310 can be reduced. As a result, a possibility that the housing 310 is damaged can be reduced.

Joining of the individual members of the thermal head X4 is described below.

First, the connector 331 and the wiring board 305 are joined together by using the jointing material 23. Then, in order to covering the first connector pin 308*a* and wiring, the first covering member 312*a* is applied by screen printing or by using a dispenser, and then dried. Then, in a state where the second covering member 312*b* has been applied to the end face of the support portion 310*g* of the connector 331, in a manner that the support portion 310*g* may come into contact with the side surface 301*b* of the heat radiating plate 301, the wiring board 305 is placed on the heat radiating plate 301 on which a double-sided tape or the like has been disposed.

After that, the head base 303 is placed on the heat radiating plate 301 so as to be adjacent to the wiring board 305. Then, the wiring board 305 and the head base 303 are electrically connected together through wires by a wire bonding method.

After that, the coating resin 329 is applied so as to cover the drive IC 311 by printing or by using a dispenser, and then cured. Here, such a method may be employed that the head base 303 and the wiring board 305 are joined to the heat radiating plate 301 and, after that, the first covering member 312*a* and the second covering member 312*b* are applied and then cured.

Embodiments of the invention has been described above. However, the invention is not limited to the embodiments given above, and various changes are possible without departing from the scope of the invention. For example, description has been given for the thermal printer Z1 employing the thermal head X1 according to the first embodiment. However, employable configurations are not limited to this, and the thermal head X2 to X4 may be employed in the thermal printer Z1. Further, thermal heads X1 to X4 according to a plurality of the embodiments may be combined together.

In the thermal heads X1 to X4, description has been given for an example that the connector 31 is disposed in the center portion in the arrangement direction. Instead, the connector 31 may be disposed in each end portion in the arrangement direction.

Further, description has been given for an example that the support portion 10*g* has a rectangular shape in a side view. However, the shape may be not rectangular. For example, the support portion 10*g* may have a semi-circular shape or a semi-elliptical shape in a side view. Further, a corner of the support portion 10*g* having a rectangular shape may be chamfered in a C-shape or an R-shape. In these cases, at the time that the head base 3 is inserted into the connector 31, a possibility of occurrence of a flaw in the head base 3 can be reduced.

Further, the ridge portion 13*b* may be not formed in the heat storage layer 13, and then the heat generating portion 9 of the electric resistance layer 15 may be disposed on the underlayer portion 13*a* of the heat storage layer 13. Further, the heat storage layer 13 may be provided over the entirety of the upper face of the substrate 7.

Further, the common electrode 17 and the individual electrode 19 may be formed on the heat storage layer 13, and then the electric resistance layer 15 may be formed only in a region between the common electrode 17 and the individual electrode 19 so that the heat generating portion 9 may be constructed.

Further, description has been given for an example of a thin film head having a thin heat generating portion 9 in which the electric resistance layer 15 is fabricated by thin film formation. However, employable configurations are not limited to this. For example, the invention may be applied to a thick film head having a thick heat generating portion 9 in which after the patterning of the various electrodes, the electric resistance layer 15 is fabricated by thick film formation. Further, the present technology may be applied to an end face head in which the heat generating portion 9 is formed in an end face of the substrate.

Here, the coating resin 29 and the covering member 12 may be fabricated from the same material. In this case, at the time of printing of the coating resin 29, the printing may be performed also in the region where the covering member 12 is to be formed, so that the coating resin 29 and the covering member 12 may simultaneously be formed.

REFERENCE SIGNS LIST

X1-X4: Thermal head
Z1: Thermal printer
1: Heat radiating plate
3: Head base
7: Substrate
8: Connector pin
8*a*: First connector pin
8*b*: Second connector pin
8*c*: Third connector pin
8*d*: Fourth connector pin
9: Heat generating portion
10: Housing
10*a*: Upper wall
10*b*: Lower wall
10*c*: Side wall
10*d*: Front wall
10*e*: Protruding portion

10*f*: Positioning portion
10*g*: Support portion
10*h*: Damming portion
10*i*: Cutout portion
11: Drive IC
12: Covering member
13: Heat storage layer
15: Electric resistance layer
17: Common electrode
19: Individual electrode
21: First connecting electrode
23: Jointing material
25: Protection layer
26: Second connecting electrode
27: Covering member
29: Coating resin

The invention claimed is:

1. A thermal head, comprising:
a substrate;
a plurality of heat generating portions disposed on the substrate;
a plurality of electrodes which are disposed on the substrate and are electrically connected to the plurality of heat generating portions, respectively; and
a connector including a plurality of connector pins which pinch the substrate and are electrically connected to the plurality of electrodes, respectively, and a housing for containing the plurality of connector pins,
the housing being disposed adjacent to the substrate in a sub-scanning direction,
the housing including a support portion disposed under the substrate, and
the substrate and the support portion being apart from each other.

2. A thermal head, comprising:
a substrate;
a plurality of heat generating portions disposed on the substrate;
a plurality of electrodes which are disposed on the substrate and are electrically connected to the plurality of heat generating portions, respectively;
a wiring board which is disposed adjacent to the substrate and includes a plurality of wirings electrically connected to the plurality of electrodes, respectively; and
a connector including a plurality of connector pins which pinch the wiring board and are electrically connected to the plurality of wirings, respectively, and a housing for containing the plurality of connector pins,
the housing being disposed adjacent to the wiring board in a sub-scanning direction,
the housing including a support portion disposed under the wiring board, and
the wiring board and the support portion being apart from each other.

3. The thermal head according to claim 2, further comprising a covering member which covers at least part of the respective connector pins, wherein
the covering member is disposed between the wiring board and the support portion.

4. The thermal head according to claim 2, wherein
the connector pins each include a first connector pin electrically connected to the wiring, a second connector pin having a contact portion connected to the wiring board, and a third connector pin linking the first connector pin and the second connector pin to each other;
the first connector pin and the second connector pin pinch the wiring board; and
the second connector pin protrudes from the wiring board beyond the first connector pin, and the contact portion is disposed on a third connector pin side relative to a tip of the first connector pin.

5. The thermal head according to claim 2, wherein the housing further includes a protruding portion disposed between adjacent connector pins of the plurality of connecter pins in a plan view.

6. The thermal head according to claim 5, wherein the protruding portion is provided with a cutout portion.

7. The thermal head according to claim 2, further comprising a heat radiating plate which is disposed under the substrate and radiates heat of the substrate, wherein
the housing is disposed adjacent to a side surface of the heat radiating plate, and
the side surface and the support portion are connected together with resin.

8. The thermal head according to claim 2, further comprising a covering member disposed on the plurality of connector pins, wherein
the covering member includes a first portion disposed on the housing and a second portion protruding from the first portion in a direction of traveling away from the heat generating portion in a plan view.

9. The thermal head according to claim 8, wherein each end portion of the housing in a main scanning direction is provided with the second portion.

10. A thermal printer, comprising:
a thermal head according to claim 2;
a conveying mechanism which conveys a recording medium onto the plurality of heat generating portions; and
a platen roller which presses a recording medium against the plurality of heat generating portions.

11. The thermal head according to claim 1, further comprising a covering member which covers at least part of the respective connector pins, wherein
the covering member is disposed between the substrate and the support portion.

12. The thermal head according to claim 1, wherein the housing further includes a protruding portion disposed between adjacent connector pins of the plurality of connecter pins in a plan view.

13. The thermal head according to claim 12, wherein the protruding portion is provided with a cutout portion.

14. The thermal head according to claim 1, further comprising a heat radiating plate which is disposed under the substrate and radiates heat of the substrate, wherein
the housing is disposed adjacent to a side surface of the heat radiating plate, and
the side surface and the support portion are connected together with resin.

15. The thermal head according to claim 1, wherein
the connector pins each include a first connector pin electrically connected to the electrode, a second connector pin having a contact portion connected to the substrate, and a third connector pin linking the first connector pin and the second connector pin to each other;
the first connector pin and the second connector pin pinch the substrate; and
the second connector pin protrudes from the substrate beyond the first connector pin, and the contact portion is disposed on a third connector pin side relative to a tip of the first connector pin.

16. The thermal head according to claim 1, further comprising a covering member disposed on the plurality of connector pins, wherein the covering member includes a first portion disposed on the housing and a second portion protruding from the first portion in a direction of traveling away from the heat generating portion in a plan view.

17. The thermal head according to claim 16, wherein each end portion of the housing in a main scanning direction is provided with the second portion.

18. A thermal printer, comprising:

a thermal head according to claim 1;

a conveying mechanism which conveys a recording medium onto the plurality of heat generating portions; and a platen roller which presses a recording medium against the plurality of heat generating portions.

* * * * *